US008690239B2

(12) United States Patent
Ishikawa et al.

(10) Patent No.: US 8,690,239 B2
(45) Date of Patent: Apr. 8, 2014

(54) CHAIR-TYPE MASSAGE APPARATUS

(75) Inventors: Tetsuya Ishikawa, Higashi-Osaka (JP); Koichi Numata, Higashi-Osaka (JP); Shinsaku Shimizu, Higashi-Osaka (JP)

(73) Assignee: Daito Electric Machine Industry Company Limited, Osaka (JP)

( * ) Notice: Subject to any disclaimer, the term of this patent is extended or adjusted under 35 U.S.C. 154(b) by 153 days.

(21) Appl. No.: 13/202,993

(22) PCT Filed: Apr. 1, 2011

(86) PCT No.: PCT/JP2011/058438
§ 371 (c)(1),
(2), (4) Date: Aug. 24, 2011

(87) PCT Pub. No.: WO2012/111176
PCT Pub. Date: Aug. 23, 2012

(65) Prior Publication Data

US 2012/0212018 A1 Aug. 23, 2012

(30) Foreign Application Priority Data

Feb. 18, 2011 (JP) ..... P2011-033644
Mar. 1, 2011 (JP) ..... P2011-043732

(51) Int. Cl.
*A47C 31/00* (2006.01)

(52) U.S. Cl.
USPC ..... 297/217.1; 297/69

(58) Field of Classification Search
USPC ..... 297/69, 70, 83, 84, 217.1
See application file for complete search history.

(56) References Cited

U.S. PATENT DOCUMENTS

| | | | | |
|---|---|---|---|---|
| 4,842,333 | A | 6/1989 | Meiller | |
| 6,059,364 | A * | 5/2000 | Dryburgh et al. | 297/354.13 |
| 7,293,839 | B2 * | 11/2007 | Shimizu | 297/423.36 |
| 7,708,340 | B2 * | 5/2010 | Tanizawa et al. | 297/217.3 |
| 2008/0030053 | A1 * | 2/2008 | Kamba et al. | 297/217.3 |
| 2008/0048475 | A1 * | 2/2008 | Tanizawa et al. | 297/284.6 |
| 2009/0021063 | A1 * | 1/2009 | Morita et al. | 297/319 |
| 2009/0224578 | A1 * | 9/2009 | Lo | 297/183.4 |

FOREIGN PATENT DOCUMENTS

| | | | |
|---|---|---|---|
| CN | 1371672 | A | 10/2002 |
| CN | 1647724 | A | 8/2005 |
| CN | 1674851 | A | 9/2005 |
| CN | 1736358 | A | 2/2006 |
| DE | DE 19801524 | A1 | 7/1999 |
| EP | 1555006 | A2 | 7/2005 |

(Continued)

*Primary Examiner* — Philip Gabler
(74) *Attorney, Agent, or Firm* — Birch, Stewart, Kolasch & Birch, LLP

(57) ABSTRACT

The chair-type massage apparatus is characterized in that, when placed with its back facing a room wall, it can be located near the wall and, when its seat is made movable back-and-forth, the leg kneading device mounted at the front of the seat can be used without being obstructed by the back-and-forth movement.

The chair-type massage apparatus 1 comprises the seat 2, the base frame 6, and the backrest 3 reclinably mounted at the rear of the seat. During reclining, the upper end of the backrest moves vertically along one vertical line. The leg kneading device is mounted at the front of the seat. The base frame has the seat moving mechanism 15 for moving the seat at least in the front-rear direction, and the seat has the position changing mechanism 16 for effecting positional change of the leg kneading device relative to the seat while maintaining the relative distance.

15 Claims, 17 Drawing Sheets

(56) References Cited

FOREIGN PATENT DOCUMENTS

| | | | |
|---|---|---|---|
| GB | 2068216 | A | 8/1981 |
| JP | 3-193053 | A | 8/1991 |
| JP | 4-4840 | U | 1/1992 |
| JP | 08-080230 | A | 3/1996 |
| JP | 2001-178575 | A | 7/2001 |
| JP | 2002-315800 | A | 10/2002 |
| JP | 2003062024 | A | 3/2003 |
| JP | 2004-141622 | A | 5/2004 |
| JP | 2004141022 | A | 5/2004 |
| JP | 2005-160866 | A | 6/2005 |
| JP | 2005-334284 | A | 12/2005 |
| JP | 2005-349102 | A | 12/2005 |
| JP | 2006-223722 | A | 8/2006 |
| JP | 2007253763 | A | 10/2007 |
| JP | 2008-220428 | A | 9/2008 |
| JP | 2010268902 | A | 12/2010 |
| TW | TW 201012461 | A | 4/2010 |
| TW | TW 13319815 | B | 10/2010 |
| TW | TW 410515 | U | 9/2011 |
| WO | WO 2008/108047 | A1 | 9/2008 |

* cited by examiner

CHAIR-TYPE MASSAGE APPARATUS

TECHNICAL FIELD

The present invention relates to a chair-type massage apparatus.

BACKGROUND ART

An example of chair-type massage apparatuses is disclosed in Patent Literature 1. This chair-type massage apparatus comprises a seat having a backrest at the rear and a leg kneading device at the front. The backrest is provided with a massage mechanism for massaging the back of a user, and the leg kneading device has a built-in lower leg massage mechanism for massaging the lower legs of a user. In the chair-type massage apparatus disclosed in Patent Literature 1, the backrest is reclinably mounted for forward and backward tilting motion (rising and falling motion), and the leg kneading device is mounted on the front side of the seat for rocking motion via a support member.

With the reclining feature imparted to the backrest, such a chair-type massage apparatus is often used with the backrest tilted backward into a reclined state.

PRIOR ART REFERENCE

Patent Literature

Patent literature 1: Japanese Unexamined Patent Publication JP-A 2005-160866

SUMMARY OF THE INVENTION

Problems to be Solved by the Invention

In the chair-type massage apparatus as described above, when the backrest is caused to fall backward into a reclined state, the upper end of the backrest projects greatly backward beyond the seat (refer to FIG. 1 of Patent literature 1). In this case, a large space needs to be secured between the chair-type massage apparatus and a wall in a room, wherefore it may be difficult to place the chair-type massage apparatus with its back opposed in close proximity to the wall. In other words, at the placement of the chair-type massage apparatus of conventional design, there arises a need to space it away from a wall in a room, in consequence whereof there results the necessity of securing a large space for the placement of the chair-type massage apparatus.

The present invention has been devised in view of the problem as mentioned supra, and accordingly the first object of the present invention is to provide a chair-type massage apparatus which has a reclining function incorporated in its backrest yet is, for example when placed with its back facing a wall in a room, able to be located closer to the wall and thus occupies less space for the placement than ever.

In connection with the chair-type massage apparatus as described above, the applicants of the present application have already come up with an apparatus equipped with a mechanism for tilting a backrest backward into a reclined state and moving a seat forward as well as upward (refer to Japanese Unexamined Patent Publication JP-A 2011-33644). In the case of employing this mechanism, when the seat is moved forward with consequent raising of the forward end of the seat and backward tilting of the backrest, then the head and waist of a user sitting on the seat are lowered to a height about on a level with his/her heart. In this way, blood circulation is less likely to concentrate at the extremities such as the lower leg of the user. Accordingly the advantage of the mechanism resides not only in a massage effect but also in recovery from fatigue.

However, in the case of imparting back-and-forth motion or up-and-down motion to the seat, it is expected that the relative positions of the seat and the leg kneading device will be caused to vary with the movement of the seat, which results in the inconvenience of using the leg kneading device during the back-and-forth movement of the seat.

The present invention has been devised in view of the problem as mentioned supra, and accordingly the second object of the present invention is to provide a chair-type massage apparatus in which, where a seat thereof is made movable back and forth or up and down, a leg kneading device mounted on the front side of the seat can be used with ease without being obstructed by the movement of the seat.

Means for Solving the Problem

In order to accomplish the first object, the following technical means is adopted for the implementation of the present invention.

That is, a chair-type massage apparatus pursuant to the present invention comprises a seat, a base frame for supporting the seat on a floor, a backrest reclinably mounted at a rear part of the seat, and a massage section for giving a massage to a user sitting on the seat. During reclining operation of the backrest, the upper end of the backrest is moved up and down along one vertical line.

It is preferable that the backrest is so designed that its upper end moves downward in response to forward movement of its lower end during backward reclining operation, whereas the upper end moves upward in response to backward movement of the lower end during forward reclining operation.

It is preferable that the seat is capable of back-and-forth movement relative to the base frame, and that the back-and-forth movement of the seat and the back-and-forth movement of the lower end of the backrest associated with the reclining operation occur in a coordinated fashion.

It is preferable that the seat is imparted a forepart-ascent action that raises the forward end thereof in response to its forward movement and a forepart-descent action that lowers the forward end in response to its backward movement.

It is preferable that, for the sake of allowing the upper end of the backrest to move up and down along one vertical line during reclining operation, the backrest has a rail member disposed so as to extend in the direction of connecting the lower end and the upper end thereof, and the base frame has a slidably holding portion for holding the rail member of the backrest for free lengthwise movement and a rotatably supporting portion for holding the slidably holding portion for free rotation about a horizontally pointing axis.

It is preferable that, for the sake of accomplishing concurrence between the back-and-forth movement of the seat and the back-and-forth movement of the lower end of the backrest associated with the reclining operation, the rear end of the seat and the lower end of the backrest are coupled to each other for free rocking motion about a horizontally pointing axis, and the base frame has a guide section for guiding the seat in free movement in a front-rear direction and an advance-retraction driving section for moving the seat in the front-rear direction.

It is preferable that the guide section of the base frame is disposed inclined forwardly and upwardly.

It is preferable that the seat has a leg kneading device for massaging the lower legs of a user mounted on the front side thereof.

It is preferable that the backrest is capable of forward tilt, and that, in order to retain the backrest in a stand-up state, there is provided engaging means for engaging the lower end of the backrest and the rear end of the seat.

In order to accomplish the second object, the following technical means is adopted for the implementation of the present invention.

That is, a chair-type massage apparatus pursuant to the present invention comprises a seat, abase frame for supporting the seat on a floor, and a leg kneading device mounted on the front side of the seat. The base frame has a seat moving mechanism for moving the seat at least in the front-rear direction. Moreover, the seat has a position changing mechanism for allowing changes in position of the leg kneading device relative to the seat while maintaining the relative distance between the seat and the leg kneading device.

It is preferable that the seat moving mechanism allows a forepart-ascent action that raises the forward end of the seat during forward movement of the seat and a forepart-descent action that lowers the forward end during backward movement of the seat, and that the position changing mechanism allows changes in position of the leg kneading device relative to the seat while maintaining the relative distance between the seat and the leg kneading device during the forepart-ascent action of the seat.

It is preferable that the seat moving mechanism includes a guide section disposed in the base frame, for guiding the seat in free movement in the front-rear direction, and an advance-retraction driving section for moving the seat in the front-rear direction, and that the position changing mechanism includes a rocking arm for providing coupling between a base pivot disposed in the seat for supporting the seat for rocking motion about a horizontally pointing axis and a front pivot disposed in the leg kneading device for supporting the leg kneading device for rocking motion about a horizontally pointing axis.

It is preferable that the position changing mechanism has a lower arm member including a forwardly extending part which is so shaped as to extend downward from the base pivot of the seat and whereafter bent to define a forwardly pointing front end, and a telescoping rod disposed for free forward sliding movement relative to the forwardly extending part, and that the front end of the telescoping rod of the lower arm member and the leg kneading device are coupled to each other for free rocking motion about a horizontally pointing axis.

It is preferable that the rocking arm of the position changing mechanism includes a forwardly extending part which is so shaped as to extend downward from the base pivot of the seat and whereafter bent to define a forwardly pointing front end, and a telescoping portion disposed for free forward sliding movement relative to the forwardly extending part, and that the telescoping portion of the rocking arm and the leg kneading device are coupled to each other for free rocking motion about a horizontally pointing axis.

It is preferable that the position changing mechanism has an intermediate link coupled to a reverse pivot disposed on each of the right and left sides of the leg kneading device for supporting the leg kneading device for rocking motion about a horizontally pointing axis, thereby allowing reverse rotation for switching between a state where the leg kneading device stays with its massage surface facing upward and a state where the leg kneading device stays with its massage surface facing the floor, that the front end of the rocking arm and one end of the intermediate link are coupled to each other for free rocking motion about a horizontally pointing axis, and that the telescoping rod of the lower arm member and the other end of the intermediate link are coupled to each other for free rocking motion about a horizontally pointing axis. In other words, it is advisable that the position changing mechanism includes an intermediate link which has its one end coupled to the front end of the rocking arm for free rocking motion about a horizontally pointing axis, and has its other end coupled to the telescoping rod of the lower arm member for free rocking motion about a horizontally pointing axis, and that the intermediate link is, at its intermediate point, coupled to a reverse pivot disposed on each of the right and left sides of the leg kneading device for supporting the leg kneading device for rocking motion about a horizontally pointing axis, so that reverse rotation can be effected for allowing switching between a state where the leg kneading device stays with its massage surface facing upward and a state where the leg kneading device stays with its massage surface facing the floor.

It is preferable that the position changing mechanism is designed to allow the leg kneading device to be housed in a housing area formed under the seat.

It is preferable that the seat has a backrest reclinably mounted at the rear part thereof, and, during reclining operation of the backrest, the upper end of the backrest moves up and down along one vertical line, and that the backrest is so designed that its upper end moves downward concurrently with forward movement of its lower end during backward reclining operation, whereas the upper end moves upward concurrently with backward movement of the lower end during forward reclining operation.

Advantageous Effects of the Invention

According to the present invention, the chair-type massage apparatus is, when placed with its back facing a wall in a room, able to be located closer to the wall and thus occupies less space for the placement than ever.

Moreover, according to the present invention, the chair-type massage apparatus is so designed that, where its seat is made movable back and forth or up and down, a leg kneading device mounted on the front side of the seat can be used without being obstructed by the movement of the seat.

MODES FOR CARRYING OUT THE INVENTION

Figure 1:
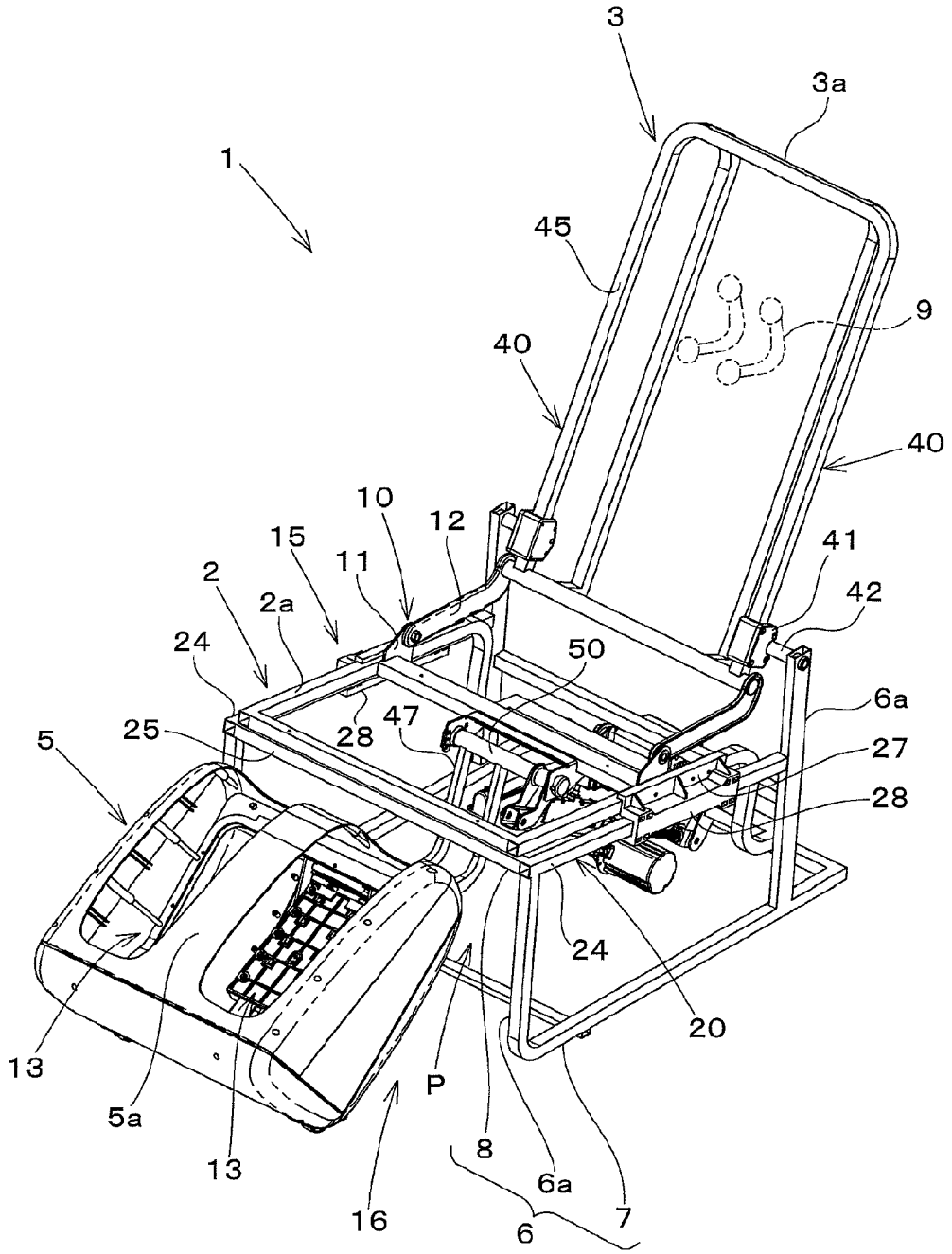
FIG. 1 is a perspective view showing a first embodiment of a chair-type massage apparatus pursuant to the present invention.

Hereinafter, embodiments of the present invention will be described with reference to the drawings.

First Embodiment

FIGS. 1 through 6 show a first embodiment of a chair-type massage apparatus pursuant to the present invention.

It is noted that, in each of the drawings, part of the construction is omitted for convenience in explanation. Moreover, in the following description, the direction of from right to left (left to right) as viewed in FIGS. 3 to 6 will be referred to as the front-rear direction of the apparatus from a practical standpoint, and the direction of from top to bottom (bottom to top) as viewed in FIGS. 3 to 6 will be referred to as the vertical direction of the apparatus from a practical standpoint. The direction of drilling through the paper sheet with each of FIGS. 3 to 6 printed on it will be referred to as the horizontal direction or widthwise direction of the apparatus from a practical standpoint. The definitions of directions conform to the sight of a user sitting on the chair-type massage apparatus 1.

To begin with, the basic structure of the chair-type massage apparatus 1 will be described. The chair-type massage apparatus 1 comprises a seat 2 (only a seat frame 2*a* is illustrated in the drawings except for FIG. 3) and a backrest 3 mounted at the rear of the seat 2 (only a back frame 3*a* is illustrated in the drawings except for FIG. 3). In addition, a leg kneading device 5 is mounted on the front side of the seat 2, for giving a kneading massage to the lower legs (calves, in particular) of a user sitting on the seat 2.

The seat 2 has an area large enough to support the buttocks of a user from below. Under the seat 2 is disposed a base frame 6 for the placement of the chair-type massage apparatus 1 on a floor F. The seat 2 is supported at a predetermined level by the base frame 6. The base frame 6 is composed of a lower frame 7 for floor mounting, an upper frame 8 disposed above the lower frame 7 at a level conforming to the level at which the seat 2 is supported, and a column support part 6*a* for providing connection between the lower frame 7 and the upper frame 8 in the vertical direction, thereby constituting a box-shaped frame as a whole.

In the first embodiment, the base frame 6 also serves for the purpose of forming a housing area P for accommodating the leg kneading device 5 (refer to FIG. 3) in the region between the lower frame 7 and the upper frame 8 in the vertical direction (the region under the seat 2).

The backrest 3 is configured to have substantially the same width as that of the seat 2, and has its lower end coupled to the rear end of the seat 2 via a rocking portion 10 for supporting it for free rocking motion about a horizontally pointing axis. In this way, the backrest 3 can be rocked freely (capable of reclining action) at the rear of the seat 2 in such a manner that its upper end falls backward, as well as rises forward. A driving mechanism for the reclining operation will hereafter be described.

In the chair-type massage apparatus 1, right-hand and left-hand hinge pieces 11 taken as a pair are disposed at the right side and the left side, respectively, of the seat frame 2*a* so as to extend upward, and right-hand and left-hand lever portions 12 taken as a pair are disposed at the lower end of the back frame 3*a* so as to extend forward in a curve. The upper end of the hinge piece 11 and the forward end of the lever portion 12 are coupled to each other by a shaft having a horizontally pointing axis. The right-hand juncture, as well as the left-hand juncture, of the hinge piece and the lever portion constitutes the rocking portion 10. The rocking portion 10 allows the lower end of the backrest 3 to be coupled to the rear end of the seat 2 for free rocking motion about the horizontally pointing axis.

The backrest 3 has a built-in vertically movable massage section 9 for giving a massage such as kneading, tapping, or vibration to the body of a user sitting on the seat 2 between the back and waist regions (refer to FIG. 1). Moreover, it is possible to install, in the interior or on the right and left sides of the seat 2, a massage section for giving a massage such as kneading, tapping, or vibration to a user sitting on the seat 2 in the body region from the waist to the buttocks, and from there to the thighs (not represented graphically).

The leg kneading device 5 is substantially quadrilateral in shape when viewed frontally, and has the shape of a rounded-triangular box when viewed laterally. The front surface of the leg kneading device 5 is designed as a massage surface 5*a* formed with a pair of right-hand and left-hand leg receiving portions 13 in which the lower legs (right and left legs) can be inserted.

The inwardly opposed surfaces of each leg receiving portion 13 have a built-in lower leg massage unit for performing a kneading massage on lower legs (not represented graphically). The lower leg massage unit may be configured to produce kneading action by imparting horizontal rocking motion to a platy member elongated in the direction of the length of a leg, or may be configured to produce kneading action by operating an airbag which is inflated and deflated with the admission and release of air.

Figure 2:
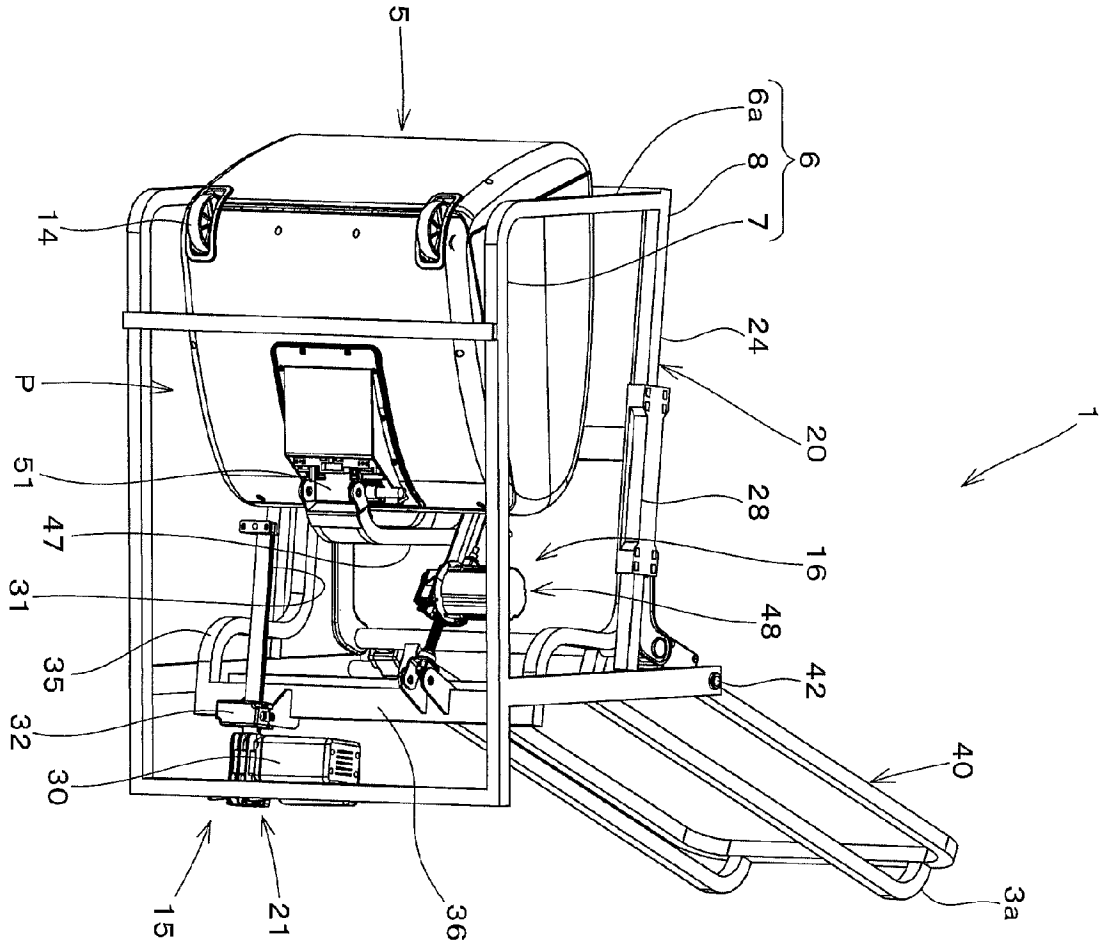
FIG. 2 is a perspective view showing the first embodiment of the chair-type massage apparatus pursuant to the present invention as viewed from below (from the back).

As shown in FIG. 2, the leg kneading device 5 has, at a corner part straddling the bottom and the back thereof, a pair of right-hand and left-hand wheels 14 mounted rotatably for rolling motion in the front-rear direction.

Thus, in the chair-type massage apparatus 1 comprising the seat 2, the backrest 3, and the leg kneading device 5, the seat 2 can be moved back and forth relative to the base frame 6, and the backrest 3 becomes capable of reclining action in response to the back-and-forth movement of the seat 2. Moreover, the leg kneading device 5 is capable of various changes in position. The back-and-forth movement of the seat 2, as well as the concurrence between the back-and-forth movement of the seat 2 and the reclining action of the backrest 3, is accomplished by a seat moving mechanism 15. The positional change of the leg kneading device 5 is accomplished by a position changing mechanism 16.

Next, the seat moving mechanism 15 will be described. The seat moving mechanism 15 comprises a guide section 20 for guiding the seat 2 in free movement in the front-rear direction and an advance-retraction driving section 21 for moving (driving) the seat 2 along the guide section 20 in the front-rear direction.

The guide section 20 is constructed of the upper frame 8 of the base frame 6. That is, the upper frame 8 is composed of: a pair of right-hand and left-hand lateral members 24 that are disposed with their lengths pointing in the front-rear direction in line with the right side and the left side, respectively, of the seat frame 2*a*; and a front member 25 acting as the connection between the forward ends of, respectively, the right-hand and left-hand lateral members 24. The right-hand, left-hand lateral member 24 is situated at a location beyond the outer dimension of the seat frame 2*a* in the widthwise direction (horizontal direction). It is noted that the lateral member 24 and the front member 25 are each formed of, for example, a hollow square pipe having a rectangular cross section.

On the other hand, the seat frame 2*a* has a pair of right-hand and left-hand overhang members 27 extending obliquely downwardly in the horizontal direction from the outer surfaces of, respectively, the right side and the left side thereof. The right-hand, left-hand overhang member 27 has a sliding portion 28 fitted onto the lateral member 24 provided in the base frame 6 for free sliding movement in the direction of the length of the lateral member 24 (viz., the front-rear direction).

Thus, the right-hand, left-hand lateral member 24 of the upper frame 8 provided in the base frame 6 is configured to hold the right-hand, left-hand sliding portion 28 disposed on the seat frame 2*a* for free sliding movement in the front-rear direction, thereby constituting the guide section 20. Since the lateral member 24 is made of a square pipe or the like, it follows that the sliding portion 28 benefits from the effect of preventing a turn about the lengthwise direction of the lateral member 24 (sliding axis) and the effect of preventing backlash. This makes it possible to accomplish stable sliding movement.

The guide section 20 (the right-hand, left-hand lateral member 24) may be disposed in parallel with the floor F (so as to stay horizontal), or may be disposed inclined forwardly and upwardly so that the forward end of the seat 2 is raised. In the case of inclining the guide section 20 forwardly and upwardly, it may be inclined linearly, or inclined upwardly with a gentle concave curve.

As the configuration adopted in the first embodiment, the lateral member 24 is gently inclined forwardly and upwardly (at a small inclination angle) in straight-line form. Accordingly, when the seat 2 is moved forward, the seat moving mechanism 15 imparts a "forepart-ascent action" to the seat 2 for gradual ascent of the forward end of the seat 2 with increasing forward movement of the seat 2, and contrariwise, when the seat 2 is moved backward, it imparts a "forepart-descent action" to the seat 2 for gradual descent of the forward end of the seat 2 with increasing backward movement of the seat 2.

In relation to such a guide section 20, there is provided the advance-retraction driving section 21 for moving (driving) the seat 2 in the front-rear direction. For example, an electric motor-driven feed screw mechanism can be adopted for the advance-retraction driving section 21. It will be apparent from FIGS. 2 and 5 that, in the motor-driven feed screw mechanism, a feed screw shaft 31, which is rotatably driven by an electric motor 30, is attached to the lower frame 7 of the base frame 6 in a forwardly-extending fashion, and a nut member 32, which threadedly engages the feed screw shaft 31, is retained at the rear end of the seat frame 2*a* while being restrained against rotation about the axis of the feed screw shaft 31.

At the rear end of the seat frame 2*a* are disposed tail frames 35 that are each bent downward and further bent rearward to define a crank form. The rear ends of, respectively, the right-hand and left-hand tail frames 35 are coupled to each other by a rear member 36, and the nut member 32 is held by this rear member 36. The feed screw shaft 31 is disposed inclined forwardly and upwardly. This is because, since the lateral member 24 of the base frame 6, viz., the guide section 20 for guiding the seat 2 in back-and-forth movement is inclined forwardly and upwardly, it is necessary to render the direction of the back-and-forth movement of the nut member 32 parallel to the guide section.

As will be apparent from the foregoing, upon actuation of the advance-retraction driving section 21 (when the nut member 32 is moved back and forth as the feed screw shaft 31 is rotated by the electric motor 30 thereby causing the seat frame 2*a* to be pushed and pulled in the front-rear direction), then the seat 2 is moved back and forth along the guide section 20. Since the seat 2 and the backrest 3 are coupled to each other via the rocking portion 10 described previously, it follows that the lower end of the backrest 3 is moved forward responsively to the forward movement of the seat 2, and is contrariwise moved backward responsively to the backward movement of the seat 2.

However, for lack of the capability of reclining operation of the backrest 3 in the construction thus far described, the following structure is added to the seat moving mechanism 15.

That is, the backrest 3 is provided with a rail member 40 extending in the direction of connecting the lower end and the upper end thereof, and the base frame 6 is provided with a slidably holding portion 41 for holding the rail member 40 of the backrest 3 and a rotatably supporting portion 42 for holding the slidably holding portion 41 in itself.

More specifically, the rail member 40 of the backrest 3 is constructed of, out of the constituent parts of the back frame 3*a* of the backrest 3, a pair of right-hand and left-hand vertical members 45 disposed along the lengthwise direction of the back frame (the direction of the spine of a user sitting on the seat while leaning at his/her back on the backrest 3). It is noted that the vertical member 45 is formed of, for example, a hollow square pipe having a rectangular cross section.

On the other hand, the slidably holding portion 41 of the base frame 6 is fitted onto the rail member 40 of the backrest 3 (the right-hand, left-hand vertical member 45) so as to hold the rail member 40 for free relative movement in the lengthwise direction. Since the vertical member 45 is made of a square pipe or the like, it follows that the slidably holding portion 41 benefits from the effect of preventing a turn about the lengthwise direction of the vertical member 45 (movement axis) and the effect of preventing backlash. This makes it possible to accomplish stable relative movement.

Meanwhile, the rotatably supporting portion 42 holds the slidably holding portion 41 for free rotation about a horizontally pointing axis. The rotatably supporting portion 42 is so disposed as to protrude horizontally inwardly from a location corresponding to the upper part, which extends upward beyond the upper frame 8, of the column support part 6*a* at the rear of the base frame 6, for holding the slidably holding portion 41 at its front end in the protruding direction.

That is, at the time of the forward movement of the seat 2, when a forwardly pulling action is transmitted via the rocking portion 10 to the lower end of the backrest 3, then the rail member 40 of the backrest 3 begins to slide downward inside the slidably holding portion 41, and also the slidably holding portion 41 begins to rotate about the center of rotation supported on the rotatably supporting portion 42 as a pivotal point in the direction of tilting the upper end of the backrest 3 backward. With the resultant synergy between the downward sliding movement of the rail member 40 and the backward rotation of the slidably holding portion 41, the backrest 3 undergoes reclining process in such a way that it falls backward, with its lower end moving forward concurrently with the forward movement of the seat 2, whereas its upper end moving downward.

On the other hand, at the time of the backward movement of the seat 2, when a backwardly pushing action is transmitted via the rocking portion 10 to the lower end of the backrest 3, then the rail member 40 of the backrest 3 begins to slide upward inside the slidably holding portion 41, and also the slidably holding portion 41 begins to rotate about the center of rotation supported on the rotatably supporting portion 42 as a pivotal point in the direction of raising the upper end of the backrest 3 forward. With the resultant synergy between the upward sliding movement of the rail member 40 and the forward rotation of the slidably holding portion 41, the backrest 3 undergoes reclining process in such a way that it rises forward, with its lower end moving backward concurrently with the backward movement of the seat 2, whereas its upper end moving upward.

During the reclining action in the backward direction, in the backrest 3, the rail member 40 slides downward inside the slidably holding portion 41. In other words, as the backward reclining action proceeds further and further, the backrest 3 is pulled forward further and further. As a result, the upper end of the backrest 3 moves downward along one vertical line. Accordingly, when the chair-type massage apparatus 1 is observed on the whole, it never occurs that the upper end of the backrest 3 projects greatly backward compared to the yet-to-be-reclined state.

It is noted that, as used herein, "move along one vertical line" does not strictly mean that a specific one point moves constantly on one straight line (absolutely no deviation), but is construed as encompassing, for example, a case where a certain part which can be regarded as the upper end of the backrest 3 moves up and down substantially rectilinearly without causing significant deviation out of course.

It will thus be seen that, for example, even if the chair-type massage apparatus 1 is placed close to a wall W in a room, since the upper end of the backrest 3 is less likely to make contact with the wall W in a room during the backward reclining operation, as a natural consequence the chair-type massage apparatus 1 can be placed closer to the wall W in a room. This affords the advantage of being able to avoid taking up unnecessarily large space to make the room small.

It is needless to say that, also in the case where the backrest 3 is caused to rise forward (forward reclining action) after the backward reclining operation, since it never occurs that the upper end of the backrest 3 projects greatly backward compared to the yet-to-be-reclined state, it is possible to attain the advantage of being able to place the chair-type massage apparatus 1 closer to the wall W in a room.

Next, the position changing mechanism 16 for allowing changes in position of the leg kneading device 5 will be described.

Figure 5:
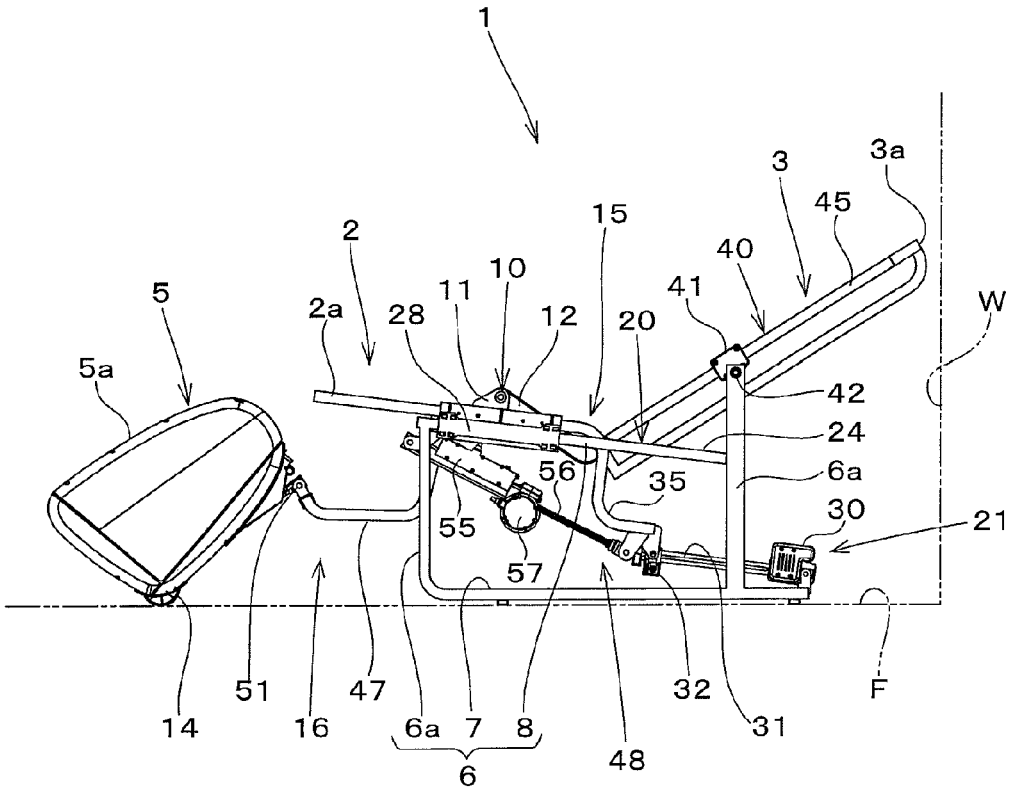
FIG. 5 is a side view of the first embodiment of the chair-type massage apparatus, illustrating a condition where the backrest is subjected to backward reclining operation and the leg kneading device is moved to project forward.

As will be apparent from FIGS. 1, 2, 5, and so forth, the position changing mechanism 16 comprises a rocking arm 47 for coupling the seat 2 and the leg kneading device 5 together and a positioning driving section 48 for rockably driving the rocking arm 47.

As shown in FIG. 1, the seat 2 is provided with a base pivot 50 for the coupling to the base end of the rocking arm 47. The base pivot 50 is disposed substantially centrally of the seat frame 2*a* (located between the right-hand and left-hand rocking portions 10), with its axis pointing in the horizontal direction, for supporting rocking motion about the axis. Moreover, as shown in FIG. 2, the leg kneading device 5 is provided with a front pivot 51 for the coupling to the front end of the rocking arm 47. The front pivot 51 is disposed at an upper part of the back surface of the leg kneading device 5, with its axis pointing in the horizontal direction, for supporting rocking motion about the axis.

Figure 3:
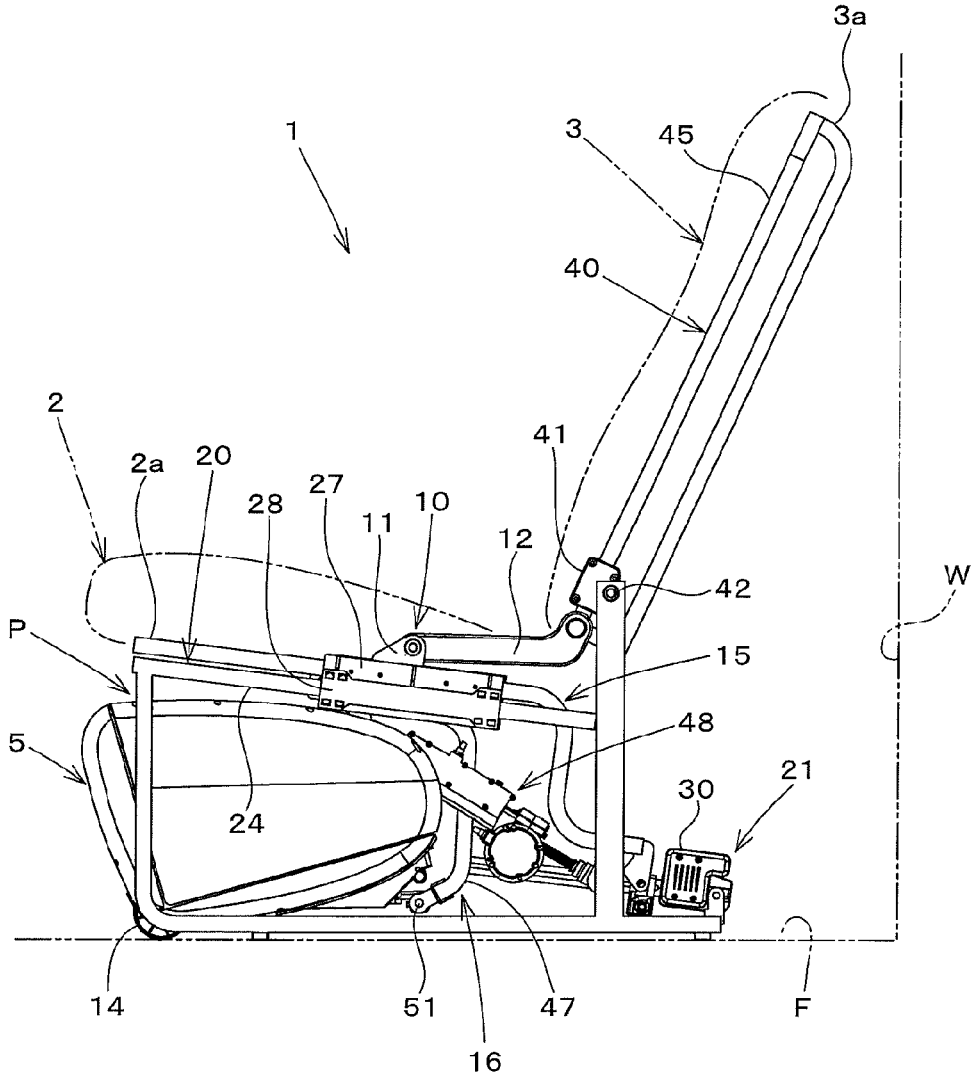
FIG. 3 is a side view of the first embodiment of the chair-type massage apparatus, illustrating a condition where a backrest is in a stand-up state and a leg kneading device is housed in place.

As shown in FIG. 3, the rocking arm 47 has an approximately right-angle bend formed at each of two locations thereof, namely a location in its base end-side part (coupled to the base pivot 50) and a location in its front end-side part (coupled to the front pivot 51), for the sake of preventing interferential contact with the leg kneading device 5 when the leg kneading device 5 is stored in the housing area P under the seat 2.

As the positioning driving section 48, for example, an electric motor-driven feed screw telescoping mechanism can be adopted for use. The motor-driven telescoping mechanism comprises a cylinder portion 55 and a feed screw shaft 56 extending from one end of the cylinder portion 55 in an axially unrotatable state. A nut member which threadedly engages the feed screw shaft 56 (not represented graphically) is housed in the cylinder portion 55. That is, as the nut member is rotated about the feed screw shaft 56 by an electric motor 57 installed in the cylinder portion 55, the feed screw shaft 56 is allowed to telescope relative to the cylinder portion 55.

The motor-driven telescoping mechanism is provided with a radial lever extending radially from the base pivot 50 of the seat frame 2*a*, to which is coupled the forward end of the cylinder portion 55. Moreover, the rear end of the feed screw shaft 56 retained in a state of extending backward from the cylinder portion 55 is coupled to the rear member 36 of the seat frame 2*a* (tail frame 35).

As will be apparent from the foregoing, upon actuation of the positioning driving section 48 (when the nut member is rotated by the electric motor 57 to impart telescopic motion to the feed screw shaft 56 thereby causing the rocking arm 47 to rock in the front-rear direction), then the leg kneading device 5 is pushed forward beyond the base frame 6, and is contrariwise pulled toward the base frame 6. Since the leg kneading device 5 has the wheels 14 capable of rolling over the floor F in the front-rear direction, it is possible to carry out the pushing and pulling of the leg kneading device 5 smoothly on the floor F.

Moreover, the leg kneading device 5 is so designed that its upper end can be readily rocked about the wheel 14 as a pivotal point in the front-rear direction. Accordingly, when the leg kneading device 5 is pushed forward by the forward rocking motion of the rocking arm 47, its upper part rises gradually into a stand-up state. On the other hand, when the leg kneading device 5 is pulled backward by the backward rocking motion of the rocking arm 47, its upper part falls gradually backward.

As shown in FIG. 5, in the course of the forward rocking motion of the rocking arm 47, even if a user sitting on the seat 2 is taking a relaxed position with his/her legs stretched out forward (with his/her knees somewhat straightened), the leg kneading device 5 is allowed to stand up while being inclined backward at an angle at which the user is able to insert his/her legs into the leg receiving portions 13 of the massage surface 5*a*. Moreover, at the final stage of the forward rocking operation of the rocking arm 47, the leg kneading device 5 is allowed to stand up in an upright position so that the user is able to put his/her legs therein with ease while bending his/her knees to a right angle.

Meanwhile, at the final stage of the backward rocking operation of the rocking arm 47, as shown in FIG. 3, the leg kneading device 5 falls backward until its back surface is opposed in close proximity to the floor F, so that it can be stored in the housing area P under the seat 2.

In the position changing mechanism 16 thereby constructed, as has already been described, the rocking arm 47 is coupled between the seat 2 and the leg kneading device 5, and the positioning driving section 48 (motor-driven telescoping mechanism) for rockably driving the rocking arm 47 is disposed between the base pivot 50 and the rear member 36 in the seat frame 2*a*. That is, it is the seat 2 that is the basis for supporting the leg kneading device 5.

Accordingly, even if the seat 2 is moved back and forth or the forward end of the seat 2 is moved up and down by the seat moving mechanism 15 described previously, the relative distance between the seat 2 and the leg kneading device 5 stays constantly within the radius of the rocking motion of the rocking arm 47 about the base pivot 50 as a pivotal point. It can thus be said that, with such a distance-keeping relation, the position changing mechanism 16 renders the leg kneading device 5 changeable in position relative to the seat 2.

As used herein, the relative distance between the seat 2 and the leg kneading device 5 refers to a distance relation such that a user sitting on the seat 2 is able to put his/her legs in the leg kneading device 5 (able to use the leg kneading device 5) simply by stretching out the legs forward or putting the legs down in front of the seat 2 without bothering to change his/her sitting position or posture relative to the seat 2. So long as the above relation is fulfilled, no strict numerical condition is imposed on the relative distance between the seat 2 and the leg kneading device 5.

Figure 4:
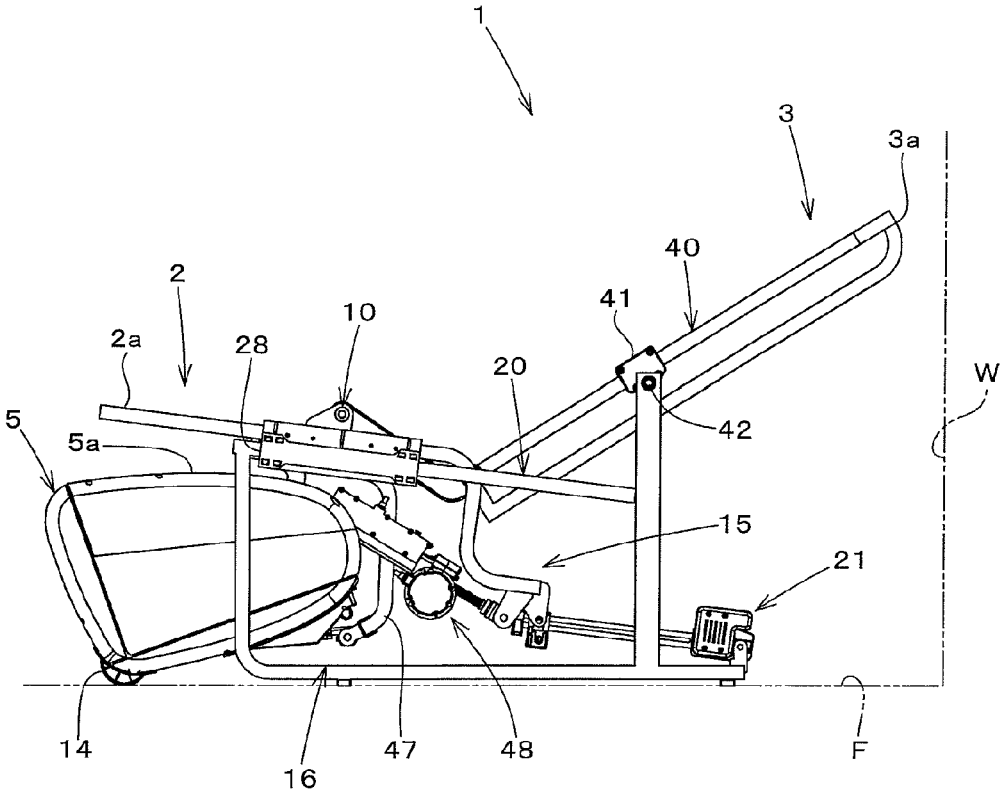
FIG. 4 is a side view of the first embodiment of the chair-type massage apparatus, illustrating a condition where the backrest is subjected to backward reclining operation and the leg kneading device is housed in place.
Figure 6:
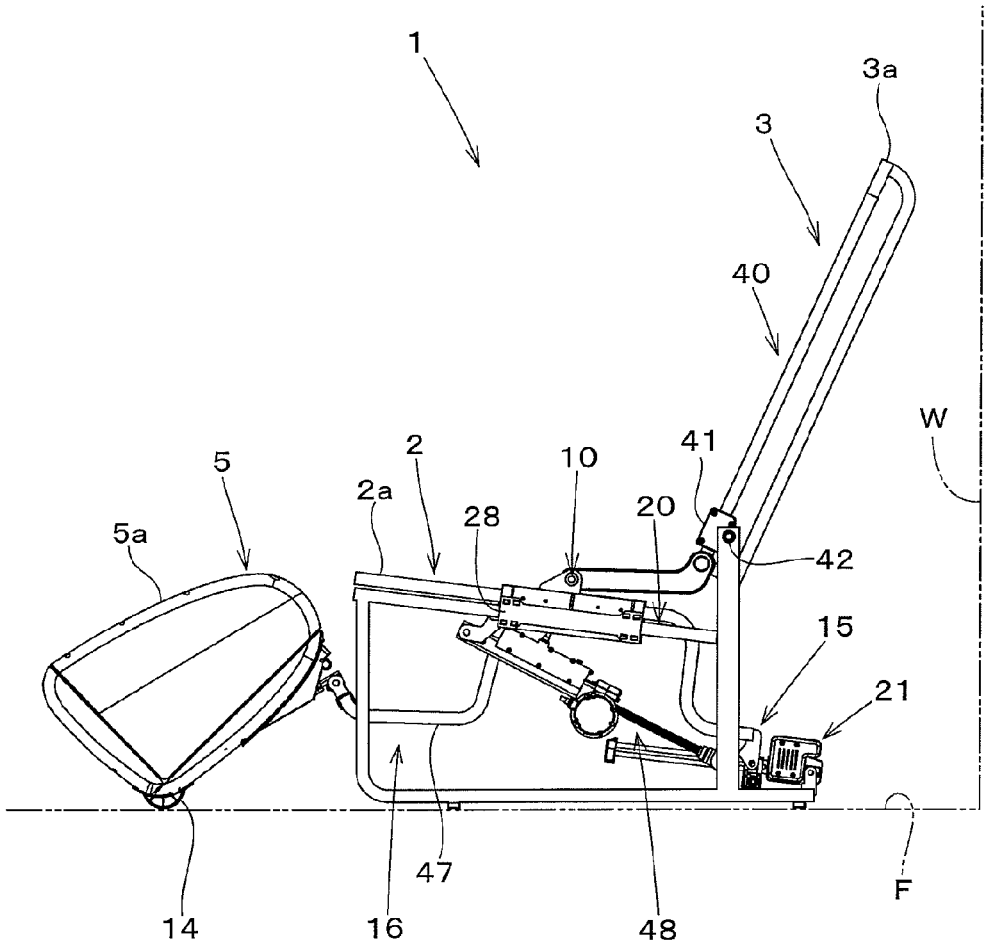
FIG. 6 is a side view of the first embodiment of the chair-type massage apparatus, illustrating a condition where the backrest is in a stand-up state and the leg kneading device is moved to project forward.

Accordingly, for example, as shown in FIG. 4, it is possible to achieve a condition where the backrest 3 is operated for backward reclining action, whereas the seat 2 is moved forward, with the leg kneading device 5 kept in the housing area P under the seat 2 (in fact, a condition where the leg kneading device 5 is at rest). Also, as shown in FIG. 6, it is possible to achieve a condition where the leg kneading device 5 is moved to project forward, whereas the seat 2 is moved backward, with the backrest 3 placed in a forward reclining state. In this way, a user is able to make selections from various apparatus usage conditions at will.

Now, a brief description will be given as to the operation modes of the chair-type massage apparatus 1 having the structure described heretofore.

Firstly, as shown in FIG. 3, let it be assumed that the seat 2 has a retracted position, the backrest 3 is in the forward reclining state, and the leg kneading device 5 lies in the housing area P under the seat 2. When in the housing area P, the leg kneading device 5 stays with its bottom surface facing forward and its massage surface 5*a* facing upward. Moreover, the bottom surface is substantially flush with the forward end of the seat 2.

In this condition, upon actuation of the electric motor 30 of the seat moving mechanism 15, as shown in FIG. 4, as the seat 2 is moved forward, the lower end of the backrest 3 is pulled forward via the rocking portion 10, with the consequence that the backrest 3 undergoes backward reclining process in such a way that it falls backward, with its upper end moving downward.

Accordingly, a user sitting on the seat 2 under this condition is able to take a relaxed position with his/her upper body leaning backward. As a matter of course, at this time, by setting the massage section 9 or the like installed in the backrest 3 in motion, the user is able to enjoy a massage to the upper body (the back, for example) while keeping the relaxed position.

Upon driving the electric motor 57 of the position changing mechanism 16 to run by user's choice or otherwise, as shown in FIG. 5, the leg kneading device 5 is pushed forward from the housing area P into a stand-up state on the basis of the seat 2. At this time, since the leg kneading device 5 is placed in front of the seat 2, it is possible for a user to insert his/her legs into the leg receiving portions 13 of the massage surface 5*a* with ease while taking a relaxed position with the legs stretched out forward (with the knees somewhat straightened). As a matter of course, at this time, by setting the lower leg massage unit of the leg kneading device 5 in motion, the user is able to enjoy a massage to the lower legs while sitting in the relaxed position.

When a user wants to raise his/her upper body up, in contrast to the above case, by driving the electric motor 30 of the seat moving mechanism 15 to run in reverse, as shown in FIG. 6, the seat 2 is moved backward, and the lower end of the backrest 3 is pushed backward via the rocking portion 10 correspondingly. As a result, the backrest 3 undergoes forward reclining process in such a way that it rises forward, with its upper end moving upward.

Moreover, when it is desired to stop or suspend the operation of the chair-type massage apparatus 1, in contrast to the above case, by driving the electric motor 57 of the position changing mechanism 16 to run in reverse, not only it is possible to accomplish the backward movement of the seat 2 and the forward reclining state of the backrest 3, but it is also possible to return the leg kneading device 5 to the original position for housing as shown in FIG. 3.

When set in the housing area P, the leg kneading device 5 stays with its bottom surface facing forward, and is restrained against protrusion from the forward end of the seat 2. As a result, the chair-type massage apparatus 1 can be used merely as a chair.

Second Embodiment

FIGS. 7 through 14 show a second embodiment of the chair-type massage apparatus pursuant to the present invention.

A chair-type massage apparatus 1 of the second embodiment comprises a seat 2 and a backrest 3 mounted at the rear of the seat 2, and in addition includes a leg kneading device 5 mounted on the front side of the seat 2. In this respect the second embodiment has the same basic structure as that of the first embodiment.

Moreover, points of similarity of the second embodiment to the first embodiment include: supporting the seat 2 at a predetermined level by the base frame 6; coupling the lower end of the backrest 3 to the rear end of the seat 2 via the rocking portion 10 for supporting the backrest for free rocking motion about a horizontally pointing axis; and mounting the massage section 9 or the like for performing a massage on a user sitting on the seat 2 in the interior of the backrest 3, or in the interior or on the right and left sides of the seat 2.

Further, the chair-type massage apparatus 1 of the second embodiment is similar to the first embodiment in that the seat moving mechanism 15 allows the seat 2 to move back and forth and accomplishes concurrence between the back-and-forth movement of the seat 2 and the reclining action of the backrest 3, and that the position changing mechanism 16 effects various changes in position of the leg kneading device 5.

The chair-type massage apparatus 1 of the second embodiment is most distinctly different than the first embodiment in terms of the seat moving mechanism 15, specifically the location of formation of the guide section 20 for guiding the seat 2 in free movement in the front-rear direction, and the position changing mechanism 16, specifically provision of a lower arm member 72 and an intermediate link 73 therein in addition to the rocking arm 47.

To begin with, the difference of the guide section 20 of the seat moving mechanism 15 in the second embodiment from that in the first embodiment will be described.

Figure 8:
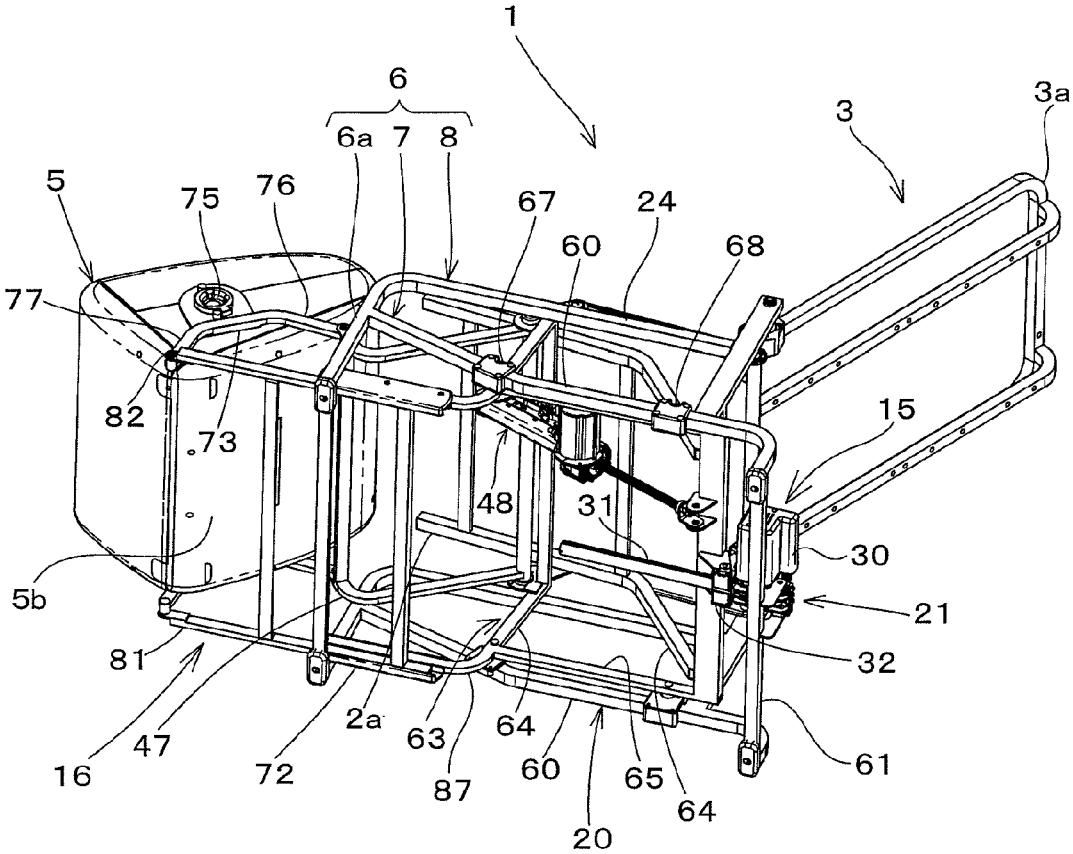
FIG. 8 is a perspective view showing the second embodiment of the chair-type massage apparatus pursuant to the present invention as viewed from below (from the back).

As shown in FIG. 8, the guide section 20 is constructed of the lower frame 7 of the base frame 6. The lower frame 7 is composed of: a pair of right-hand and left-hand lateral members 60 that are disposed, with their lengths pointing in the front-rear direction, below the upper frame 8 so as to become parallel to the right-hand and left-hand lateral members 24, respectively, of the upper frame 8; and a rear member 61 acting as the connection between the rear ends of, respectively, the right-hand and left-hand lateral members 60.

The right-hand, left-hand lateral member 60 is divided into two parts by substantially at the midpoint thereof as a boundary in the front-rear direction, the front-half part of which is inclined forwardly and upwardly (forwardly-upwardly inclined part), whereas the rear-half part of which extends in parallel with the floor F (horizontal rear part). It is noted that the lateral member 60, namely the front-half part and the rear-half part, is entirely formed of a hollow square pipe or the like having a rectangular cross section.

Meanwhile, the seat frame 2*a* has a leg frame 63 which is fitted inside the base frame 6 (within the region between the right-hand and left-hand lateral members 24). The leg frame 63 includes leg members 64 that are spaced apart in the front-rear direction, as well as spaced apart in the horizontal direction, or a total of four leg members 64 in all, and a spanning member 65 disposed so as to extend across the lower ends of the leg members 64.

In a location toward the front part of the spanning member 65 and a location toward the rear part of the same, there are arranged a sliding portion 67 (front sliding portion 67) and a sliding portion 68 (rear sliding portion 68), respectively, that are each fitted onto the lateral member 60 for free sliding movement in the direction of the length of the lateral member 60 (viz., the front-rear direction).

The front sliding portion 67 is arranged slidable back and forth along the front-half part of the lateral member 60 inclined forwardly and upwardly (the forwardly-upwardly inclined part), whereas the rear sliding portion 68 is arranged slidable back and forth along the rear-half part of the lateral member 60 that stays horizontal (the horizontal rear part).

Thus, the lateral member 60 of the lower frame 7 constituting the base frame 6 is configured to hold the front sliding portion 67 and the rear sliding portion 68 disposed on the seat frame 2*a* for free back-and-forth sliding movement in the front-rear direction, thereby constituting the guide section 20.

With such a structure of the guide section 20, when the seat 2 is moved forward, as the forward movement of the seat 2 proceeds further and further, the forward end of the seat 2 is raised further and further with a consequent forepart-ascent action. On the other hand, when the seat 2 is moved backward, as the backward movement of the seat 2 proceeds further and further, the forward end of the seat 2 is lowered further and further with a consequent forepart-descent action.

However, in this case, in contrast to the first embodiment, the forepart-ascent action of the seat 2 is brought about only by the front sliding portion 67 (the rear sliding portion 68 slides at a constant level at all sliding locations). Therefore, when the seat 2 is moved forward, its rear part will not be raised, in consequence whereof there results a condition where, the further the seat 2 is moved forward, the larger the difference in level between the front part and the rear part of the seat 2.

It is noted that, just as with the first embodiment, an electric motor-driven feed screw mechanism is adopted for the advance-retraction driving section 21 for moving (driving) the seat 2 in the front-rear direction provided in relation to such a guide section 20. That is, a feed screw shaft 31, which is rotatably driven by an electric motor 30, is attached to the lower frame 7 of the base frame 6 in a forwardly-extending fashion, and a nut member 32, which threadedly engages the feed screw shaft 31, is retained by the spanning member 65 disposed in the leg frame 63 of the seat frame 2*a* while being restrained against rotation about the axis of the feed screw shaft 31.

As has already been described, the guide section 20 has its rear-half part formed as a horizontal region along which is moved the rear sliding portion 68, and the nut member 32 is retained in the proximity of the rear sliding portion 68 in the front-rear direction. Hence the feed screw shaft 31 is so disposed as to stay horizontal without the need for inclination in the forward and upward directions.

Next, the difference of the position changing mechanism 16 for allowing changes in position of the leg kneading device 5 in the second embodiment from that in the first embodiment will be described.

As has already been described, the position changing mechanism 16 of the second embodiment comprises the rocking arm 47 for coupling the seat 2 and the leg kneading device 5 together and the positioning driving section 48 for rockably driving the rocking arm 47. In addition, the position changing mechanism 16 includes a lower arm member 72 and an intermediate link 73.

The rocking arm 47, the lower arm member 72, and the intermediate link 73 are each provided in the form of a pair of right-hand and left-hand portions (two in number). Out of the rocking arm 47, the lower arm member 72, and the intermediate link 73, the intermediate link 73 is disposed on each of the right and left sides of the leg kneading device 5.

Intermediately of its ends the intermediate link 73 is provided with a reverse pivot 75 for supporting the leg kneading device 5 for rocking motion about a horizontally pointing axis. The intermediate link 73 is so designed that coupling ends 76 and 77 extend in opposite directions from the reverse pivot 75.

Figure 7:
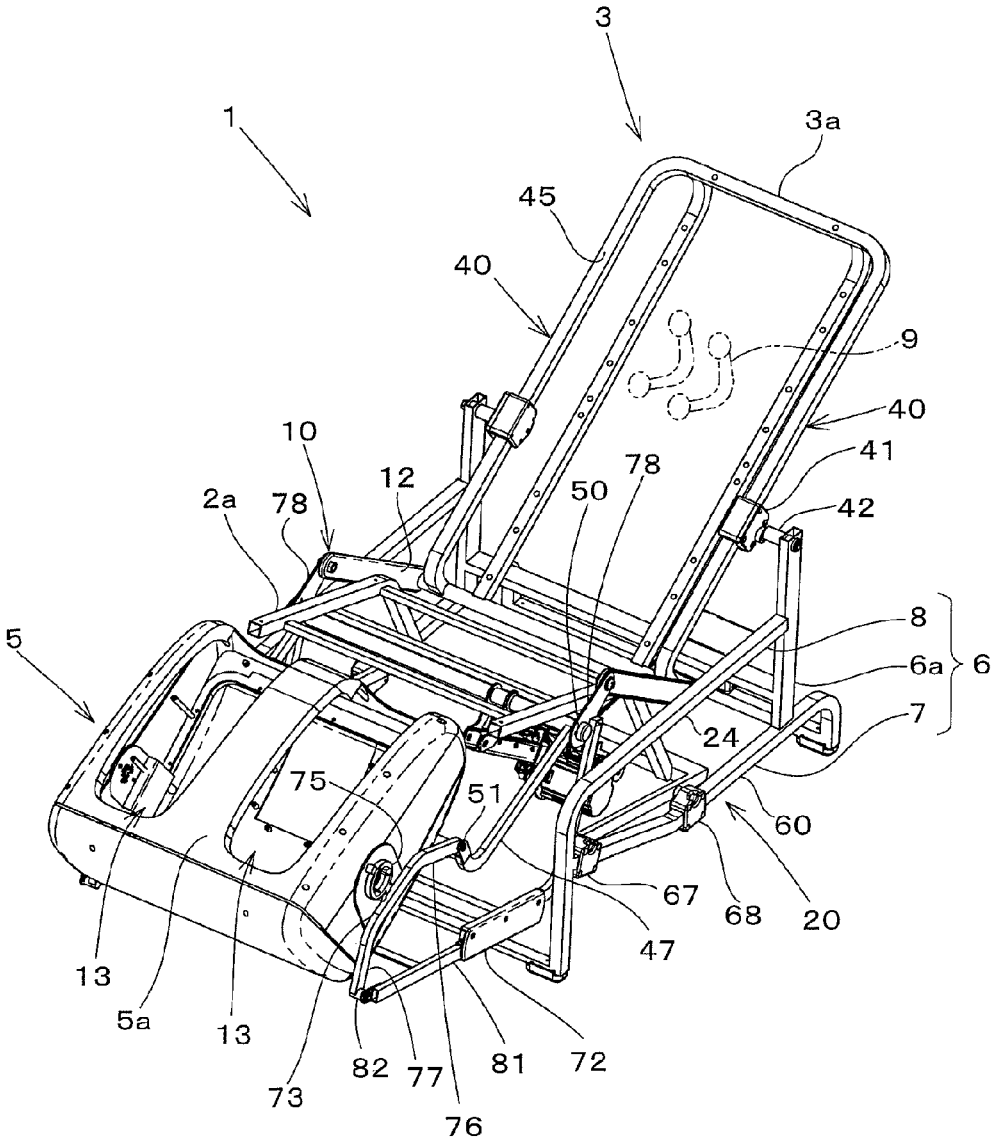
FIG. 7 is a perspective view showing a second embodiment of the chair-type massage apparatus pursuant to the present invention.

As shown in FIG. 7, the seat frame 2*a* has a pair of right-hand and left-hand bracket pieces 78 that extend obliquely downwardly in the forward direction from the right-hand and left-hand rocking portions 10, respectively. The bracket piece 78 is provided with a base pivot 50, the axis of which is pointing in the horizontal direction, for supporting rocking motion about the axis, and the base end of the rocking arm 47 is coupled via the base pivot 50 to the bracket piece 78. The front end of the rocking arm 47 thereby mounted and one end of the intermediate link 73 (one coupling end 76) are coupled to each other via a front pivot 51 for free rocking motion.

Meanwhile, the lower arm member 72 comprises: a forwardly extending part 87 which is so shaped as to extend downward from the base pivot 50 of the seat 2 and whereafter bent forward to extend forward; and a telescoping rod 81 which is held by the forwardly extending part 87 for free forward sliding movement. The front end of the telescoping rod 81 thereby mounted and the other end of the intermediate link 73 (the other coupling end 77) are coupled to each other via an auxiliary pivot 82 for free rocking motion.

Figure 9:
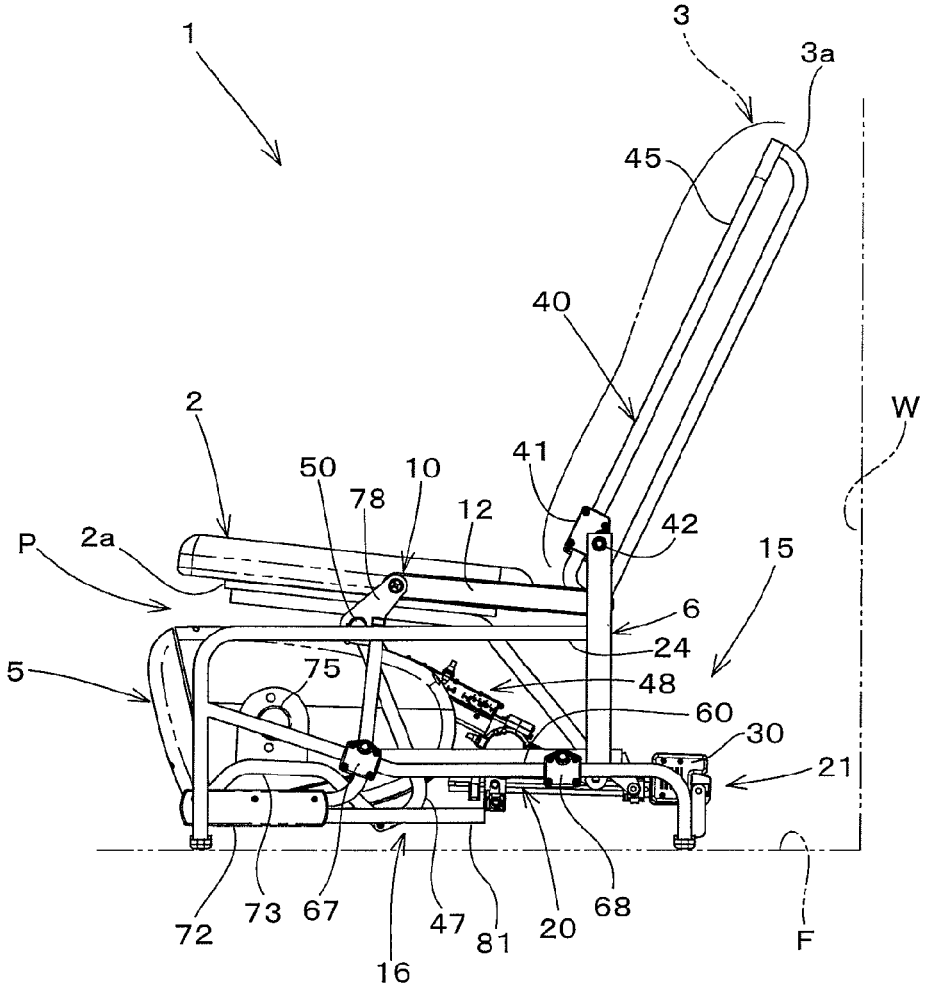
FIG. 9 is a side view of the second embodiment of the chair-type massage apparatus, illustrating a condition where the backrest is in a stand-up state and the leg kneading device is housed in place.
Figure 10:
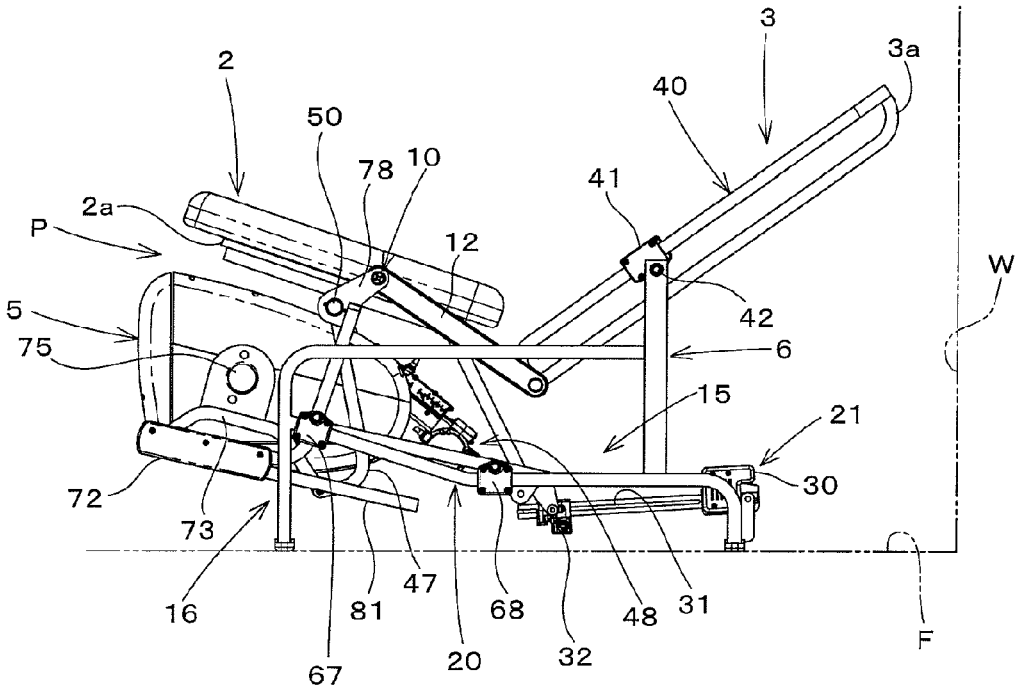
FIG. 10 is a side view of the second embodiment of the chair-type massage apparatus, illustrating a condition where the backrest is subjected to backward reclining operation and the leg kneading device is housed in place.
Figure 11:
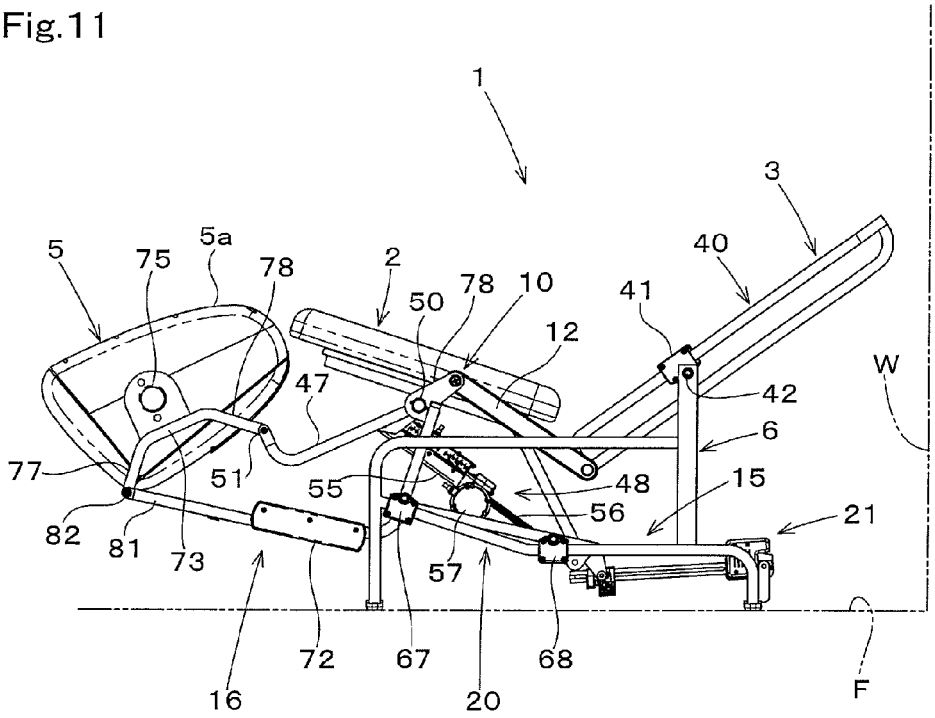
FIG. 11 is a side view of the second embodiment of the chair-type massage apparatus, illustrating a condition where the backrest is subjected to backward reclining operation and the leg kneading device is moved to project forward.
Figure 12:
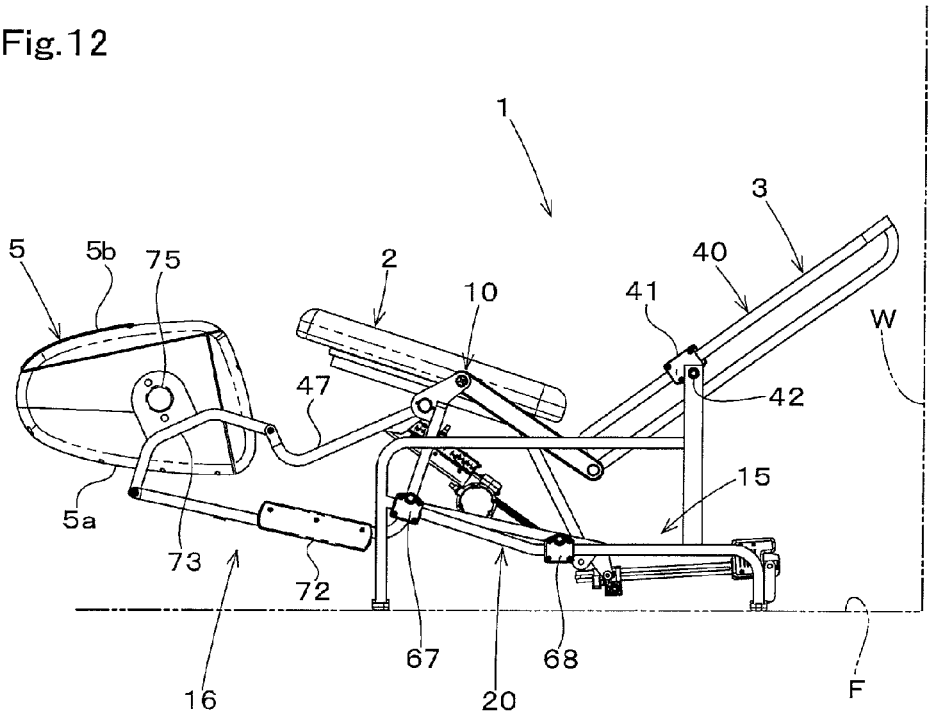
FIG. 12 is a side view of the second embodiment of the chair-type massage apparatus, illustrating a condition where the backrest is subjected to backward reclining operation and the leg kneading device is moved to project forward, with its back surface facing upward.
Figure 13:
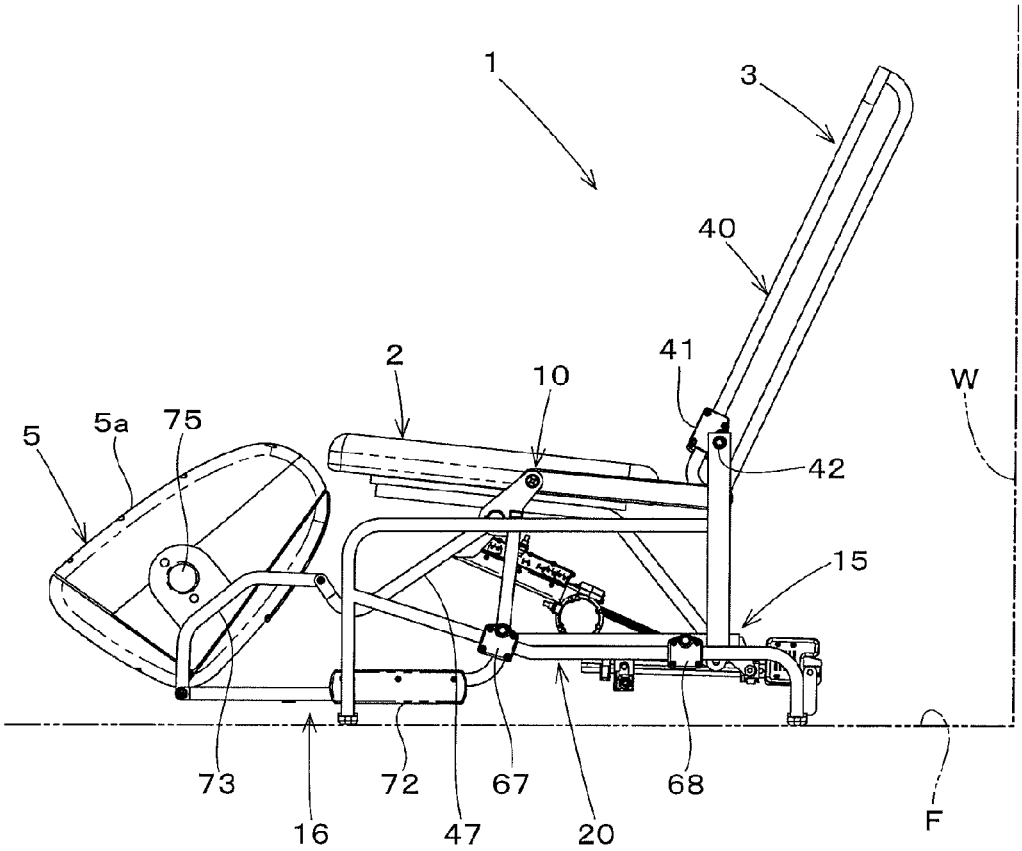
FIG. 13 is a side view of the second embodiment of the chair-type massage apparatus, illustrating a condition where the backrest is in a stand-up state and the leg kneading device is moved to project forward.
Figure 14:
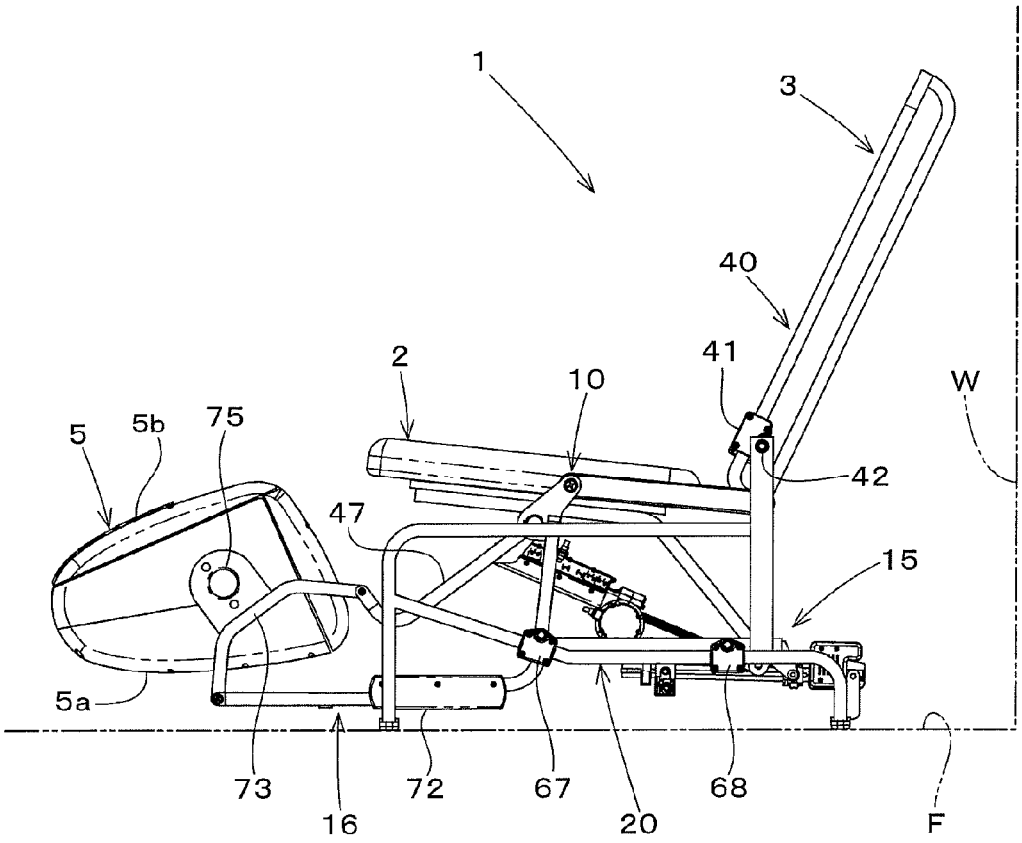
FIG. 14 is a side view of the second embodiment of the chair-type massage apparatus, illustrating a condition where the backrest is in a stand-up state and the leg kneading device is moved to project forward, with its back surface facing upward.

Thus, the leg kneading device 5 is free to rotate about the reverse pivot 75 of the intermediate link 73 and is therefore capable of reverse rotation (can be turned upside down), and is more specifically capable of switching between a state where the massage surface 5*a* faces upward as shown in FIGS. 9 and 10 and a state where the massage surface 5*a* is opposed to the floor F as shown in FIGS. 12 and 14. Moreover, in the course of the reverse rotation, as shown in FIGS. 11 and 13, the massage surface 5*a* can be brought into a forward-facing state.

When the massage surface 5*a* is opposed to the floor F, the back surface 5*b* of the leg kneading device 5 is in an upward-facing state. That is, since the leg receiving portion 13 does not point upward, it is possible for a user sitting on the seat 2 to stretch his/her legs out forward and put them on the back surface 5*b* of the leg kneading device 5.

It is noted that, just as with the first embodiment, the positioning driving section 48 is constructed of the electric motor-driven feed screw telescoping mechanism (in which the feed screw shaft 56 is allowed to telescope relative to the cylinder portion 55 by the electric motor 57).

By operating the positioning driving section 48, the leg kneading device 5 is pushed forward beyond the base frame 6, and is contrariwise pulled toward the base frame 6. Moreover, when the leg kneading device 5 is pushed forward by the forward rocking motion of the rocking arm 47, its upper part rises gradually into a stand-up state. On the other hand, when the leg kneading device 5 is pulled backward by the backward rocking motion of the rocking arm 47, its upper part falls gradually backward. A series of such actions is similar to that in the first embodiment.

It is noted that, when the rocking arm 47 is rocked forward whereupon the leg kneading device 5 is moved forward from the housing area P under the seat 2, the telescoping rod 81 of the lower arm member 72 is caused to extend forward. On the other hand, when the rocking arm 47 is rocked backward whereupon the leg kneading device 5 enters the housing area P, the telescoping rod 81 of the lower arm member 72 is retracted backward.

In this way, since the leg kneading device 5 is held by the lower arm member 72, in the second embodiment, there is no need to attach a wheel (such as shown by the numeral 14 in FIG. 2, etc.) capable of rolling over the floor F in the front-rear direction to the leg kneading device 5. Accordingly, the second embodiment is relatively simple in structure and light in weight compared to the first embodiment.

In the second embodiment, the guide section 20 for guiding the seat 2 in back-and-forth movement is made larger (steeper) in the angle of forward-upward inclination than the guide section 20 of the first embodiment. Besides, in this construction, as has already been described, the further the seat 2 is moved forward, the larger the difference in level between the front part and the rear part of the seat 2. Accordingly, as the seat 2 is moved forward further and further with consequent backward tilting of the backrest 3, then the head and waist of a user sitting on the seat are gradually lowered to a height on a level with his/her heart. As a result, blood circulation is less likely to concentrate at the extremities such as the lower leg of the user, wherefore the advantage of the construction resides not only in a massage effect but also in recovery from fatigue, etc. It is needless to say that, in this case, by causing the leg kneading device 5 to project forward, it is possible for the lower leg of the user to be supported thereon, and thereby achieve a higher degree of effectiveness.

The second embodiment is otherwise similar to the first embodiment in structure, operating conditions, functioning effect, and so forth, and the same reference symbols are utilized in the drawings in designating corresponding portions of the apparatus and overlapping detailed descriptions will be omitted.

Third Embodiment

FIGS. 15 through 18 show a third embodiment of the chair-type massage apparatus pursuant to the present invention.

A chair-type massage apparatus 1 of the third embodiment is similar in most respects to the second embodiment, except for several constructional improvements. Hence the following description deals only with points of difference of the third embodiment than the second embodiment.

Firstly, in the position changing mechanism 16 for allowing changes in position of the leg kneading device 5, as the positioning driving section 48, an electric motor-driven feed screw mechanism (in which a feed screw shaft 31 is rotated by an electric motor 30 thereby imparting back-and-forth movement to a nut member 32 which threadedly engages the feed screw shaft 31) is adopted for use. The motor-driven feed screw mechanism is so oriented that the feed screw shaft 31 is in a forwardly-extending state and the electric motor 30 is rear-mounted.

This affords the advantage of being able to increase a space area under the seat 2 (inside the base frame 6), wherefore the motor-driven feed screw mechanism adopted for the advance-retraction driving section 21 of the seat moving mechanism 15 can be so oriented that the feed screw shaft 31 is in a backwardly-extending state and the electric motor 30 is front-mounted. In this way, by employing identical motor-driven feed screw mechanisms for the positioning driving section 48 of the position changing mechanism 16 and the advance-retraction driving section 21 of the seat moving mechanism 15, it is possible to achieve commonality of constituent components of the chair-type massage apparatus 1 that will eventually result in savings in production costs. Moreover, in each of the motor-driven feed screw mechanisms, since the electric motor 30 is assembled inside the base frame 6, it is possible to prevent leakage of noise caused by motor operation and thereby render the apparatus low-noise and quiet.

Secondly, the rocking arm 47 of the position changing mechanism 16 comprises: a forwardly extending part 87 which is so shaped as to extend downward from the base pivot 50 of the seat 2 and whereafter bent forward to extend forward; and a telescoping portion 88 which is held by the forwardly extending part 87 for free forward sliding movement. At the front end of the telescoping portion 88 of the rocking arm 47 is disposed a holding plate 89 having a reverse pivot 75. The leg kneading device 5 is rotatably coupled thereto via the reverse pivot 75 of the holding plate 89.

In the third embodiment, the use of the rocking arm 47 having such a structure eliminates the provision of the lower arm member 72 and the intermediate link 73 that are required in the second embodiment.

Figure 15:
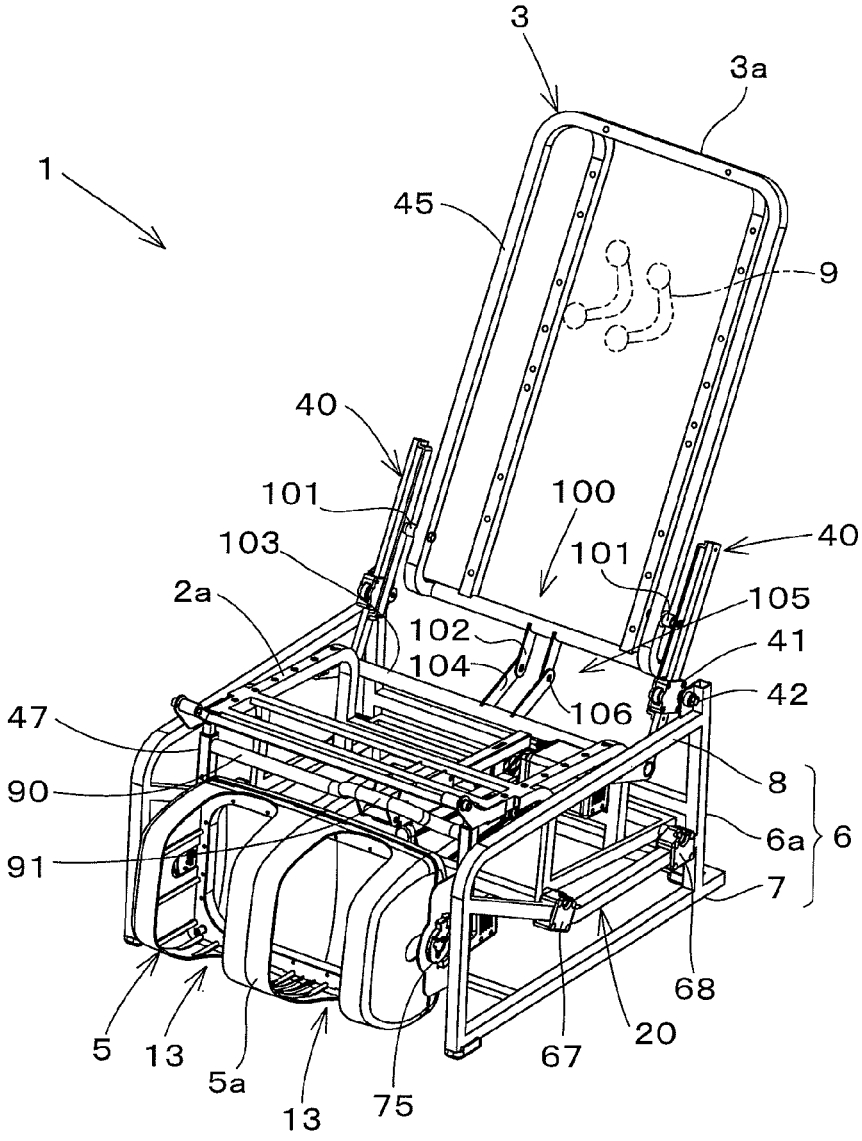
FIG. 15 is a perspective view showing a third embodiment of the chair-type massage apparatus pursuant to the present invention (the backrest is in a stand-up state).
Figure 16:
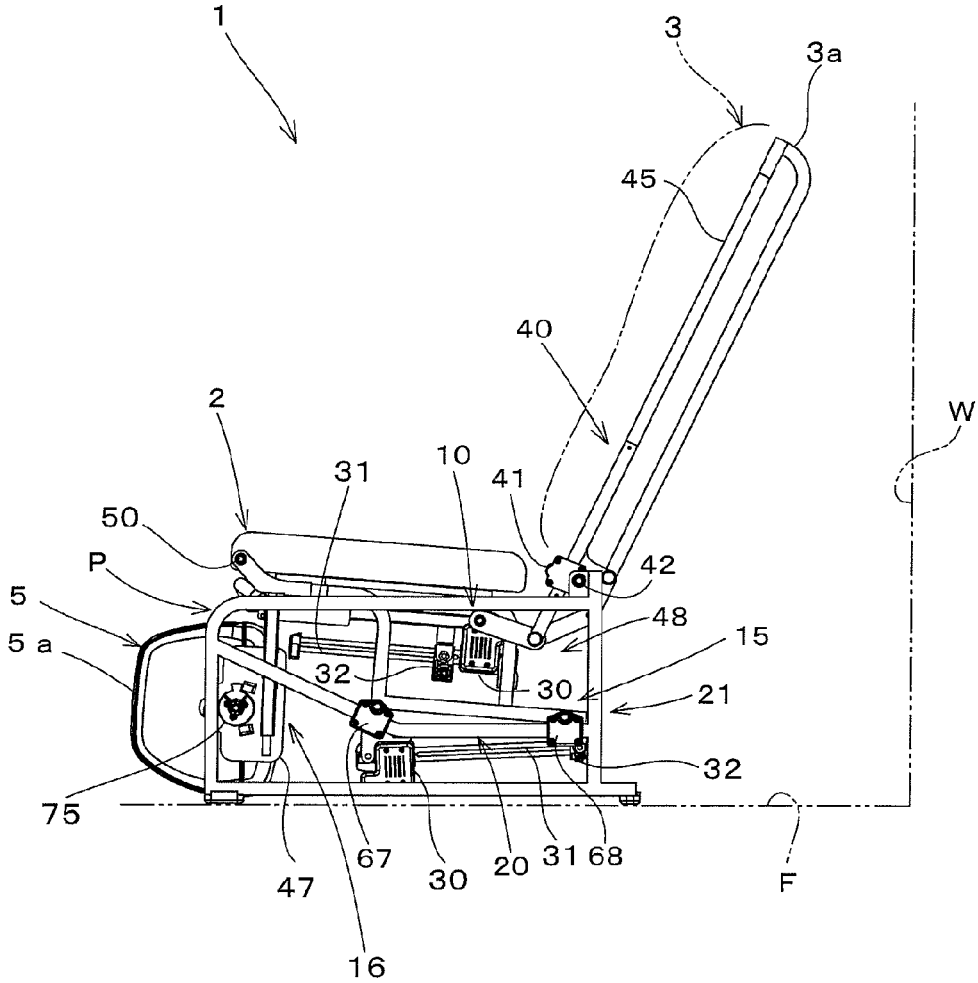
FIG. 16 is a side view of the third embodiment of the chair-type massage apparatus, illustrating a condition where the backrest is in a stand-up state and the leg kneading device is housed in place.
Figure 17:
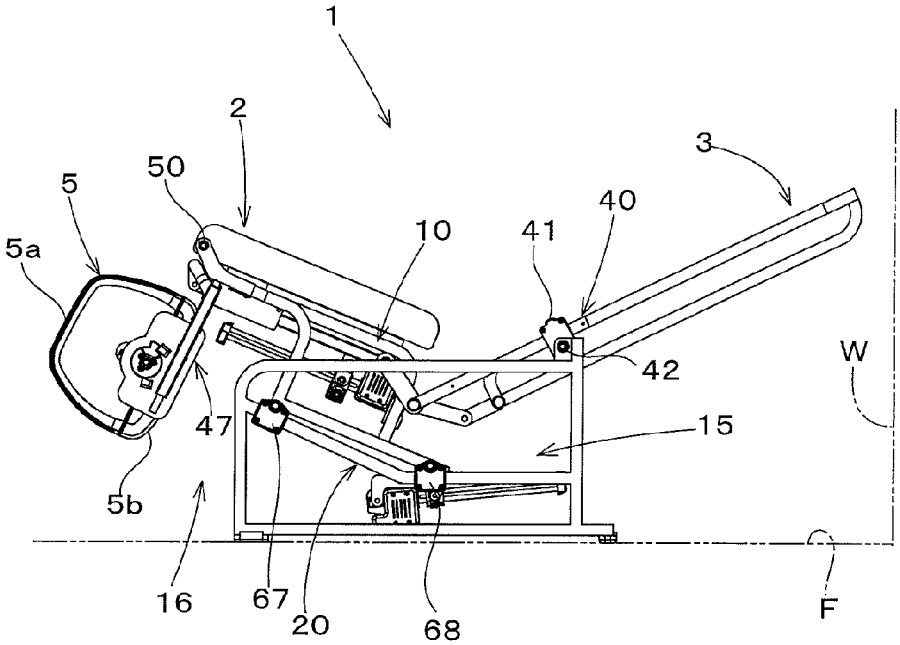
FIG. 17 is a side view of the third embodiment of the chair-type massage apparatus, illustrating a condition where the backrest is subjected to backward reclining operation and the leg kneading device hangs down from the front of the seat (into retractable position).
Figure 18:
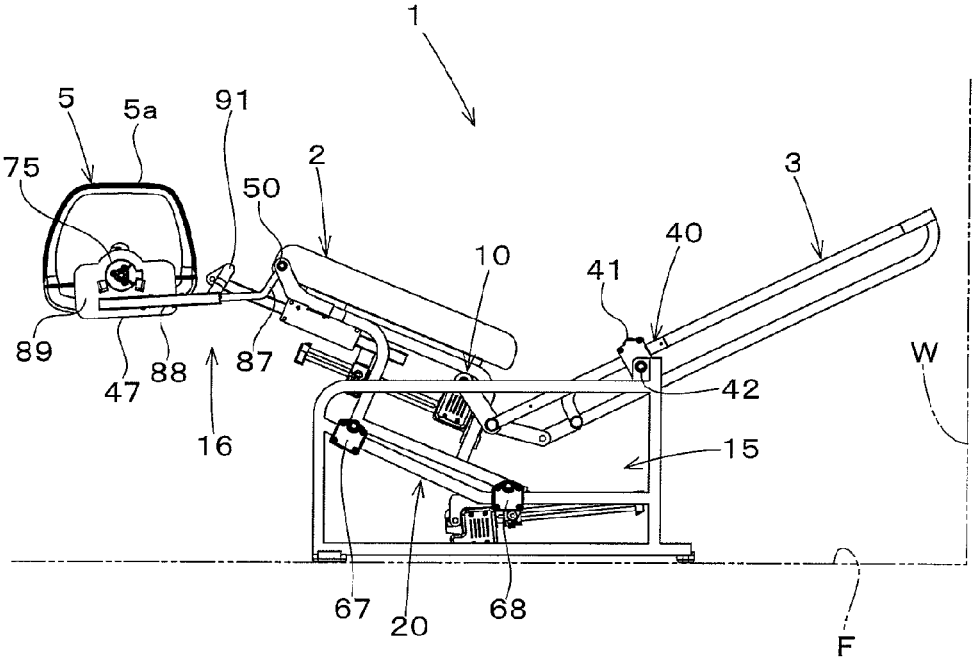
FIG. 18 is a side view of the third embodiment of the chair-type massage apparatus, illustrating a condition where the backrest is subjected to backward reclining operation and the leg kneading device is moved to project forward.

It is noted that, as shown in FIG. 15, in relation to the right-hand and left-hand rocking arms 47, a spanning member 90 is disposed so as to extend across the right-hand and left-hand telescoping portions 88. Intermediately of its lengthwise ends the spanning member 90 is provided with a convexly curved crank coupling portion 91, to which is coupled directly or indirectly the output portion of the positioning driving section 48 (the nut member 32 of the motor-driven feed screw mechanism). Moreover, the rail member 40 mounted in the backrest 3 is disposed independently of the back frame 3*a* of the backrest 3.

The chair-type massage apparatus 1 of the third embodiment is provided with a mechanism 100 capable of folding the backrest 3 forward (forwardly tilting mechanism) for the sake of rendering the apparatus 1 compact during transport or storage.

The forwardly tilting mechanism 100 has a forward-tilt pivot portion 101 for pivotally supporting the lower side of the backrest 3. The forward-tilt pivot portion 101 is disposed at each of the right and left sides of the backrest 3, for supporting the backrest 3 for free rotation about a horizontally pointing axis.

Moreover, a downwardly extending first projection piece 102 is disposed at a widthwise midpoint of the lower end of the back frame 3*a* constituting the backrest 3. In this embodiment, there is provided a pair of right-hand and left-hand first projection pieces 102. The first projection piece 102 is caused to face backward in response to a forward tilt of the backrest 3.

Meanwhile, a beam frame 103 is laid in the widthwise direction in spanning fashion at the rear side of the seat frame 2*a* constituting the seat 2. The beam frame 103 has a second projection piece 104 formed at its widthwise midpoint so as to extend in a backward-facing state. Likewise, there is provided a pair of right-hand and left-hand second projection pieces 104.

The forwardly tilting mechanism 100 has the first projection piece 102 and the second projection piece 104 that are so positioned that the tip of the first projection piece 102 overlaps the tip of the second projection piece 104 when the backrest 3 is in a stand-up state.

The forwardly tilting mechanism 100 further includes engaging means 105 for engaging the tip of the first projection piece 102 and the tip of the second projection piece 104 in unitary relation when the backrest 3 is in a stand-up state. While various mechanisms can be adopted for the engaging means 105, in this embodiment, as the engaging means 105, through holes 106 are bored in the tip of the first projection piece 102 and the tip of the second projection piece 104, respectively, in alignment with each other. By inserting a pin into these overlapping through holes 106, the first projection piece 102 and the second projection piece 104 become united thereby retaining the backrest 3 in a stand-up state.

On the other hand, when it is desired to fold the backrest 3 forward, by releasing the engagement of the pieces established by the engaging means 105, in other words, by removing the pin from the through holes 106, it is possible to effect disengagement between the first projection piece 102 and the second projection piece 104.

Figure 19:
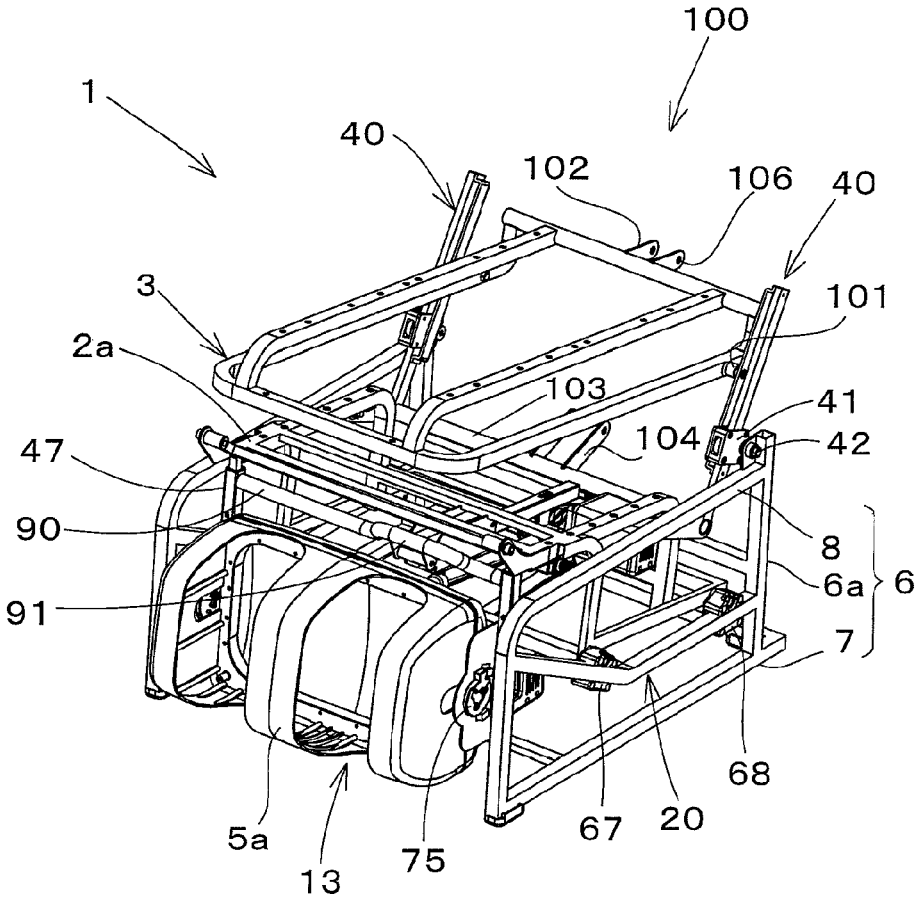
FIG. 19 is a perspective view showing the third embodiment of the chair-type massage apparatus pursuant to the present invention (the backrest is in a forwardly-tilted state).

At this time, as shown in FIG. 19, the backrest 3 is rotated about the forward-tilt pivot portion 101 for forward tilt, thereupon the backrest 3 can be placed on the top surface of the seat 2. By achieving such a condition as shown in FIG. 19, the chair-type massage apparatus 1 can be made compact in size during transport or storage.

The third embodiment described heretofore is otherwise similar to the second embodiment in structure, operating conditions, functioning effect, and so forth, and the same reference symbols are utilized in the drawings in designating corresponding portions of the apparatus and overlapping detailed descriptions will be omitted.

It is to be understood that the chair-type massage apparatus 1 pursuant to the present invention is not limited to the first to third embodiments.

For example, it is advisable to dispose a sensor such a limit switch on the top surface of the seat 2, in the leg receiving portion 13 of the leg kneading device 5, or elsewhere. In this case, the apparatus can be so designed that, when the presence of a user is detected by the sensor, or during the operation of the massage section 9 or the lower leg massage unit, the position changing mechanism 16 is kept in a nonoperating state. By adopting such a structure, it is possible to prevent inconveniences such for example as occurrence of a hurt to the lower legs of a user without fail.

EXPLANATION OF REFERENCE SYMBOLS

1 Chair-type massage apparatus
2 Seat
2*a* Seat frame
3 Backrest
3*a* Back frame
5 Leg kneading device
5*a* Massage surface
5*b* Back surface
6 Base frame
6*a* Column support part
7 Lower frame
8 Upper frame
9 Massage section
10 Rocking portion
11 Hinge piece
12 Lever portion
13 Leg receiving portion
14 Wheel
15 Seat moving mechanism
16 Position changing mechanism
20 Guide section
21 Advance-retraction driving section
24 Lateral member
25 Front member
27 Overhang member
28 Sliding portion
30 Electric motor
31 Screw shaft
32 Nut member
35 Tail frame
36 Rear member

40 Rail member
41 Slidably holding portion
42 Rotatably supporting portion
45 Vertical member
47 Rocking arm
48 Positioning driving section
50 Base pivot
51 Front pivot
55 Cylinder portion
56 Screw shaft
57 Electric motor
60 Lateral member
61 Rear member
63 Leg frame
64 Leg member
65 Spanning member
67 Front sliding portion
68 Rear sliding portion
72 Lower arm member
73 Intermediate link
75 Reverse pivot
76 Coupling end
77 Coupling end
78 Bracket piece
81 Telescoping rod
82 Auxiliary pivot
87 Forwardly extending part
88 Telescoping portion
89 Holding plate
90 Spanning member
91 Crank coupling portion
100 Forwardly tilting mechanism
101 Forward-tilt pivot portion
102 First projection piece
103 Beam frame
104 Second projection piece
105 Engaging means
106 Through hole
F Floor
P Housing area
W Wall in a room

The invention claimed is:

1. A chair-type massage apparatus comprising:
a seat;
a base frame for supporting the seat on a floor;
a backrest reclinably mounted at a rear end of the seat; and
a massage section for giving a massage to a user sitting on the seat,
wherein the backrest includes:
a lower end and an upper end, and
a rail member arranged in a lengthwise direction, with one end thereof extending toward the lower end of the backrest, and an opposite end thereof extending toward the upper end of the backrest, so that during a reclining operation, the upper end of the backrest moves up and down along one vertical line, and
wherein the base frame includes:
a slidable holding portion for holding the rail member of the backrest for free movement of the backrest in the lengthwise direction, and
a rotatable supporting portion for holding the slidable holding portion for free rotation of the slidable holding portion.

2. The chair-type massage apparatus according to claim 1, wherein the backrest is designed wherein an upper end of the backrest moves downward concurrently with a forward movement of a lower end of the backrest during a backward reclining operation,
whereas the upper end of the backrest moves upward concurrently with a backward movement of the lower end of the backrest during a forward reclining operation.

3. The chair-type massage apparatus according to claim 2, wherein the seat is capable of back-and-forth movement relative to the base frame, and
the back-and-forth movement of the seat and the back-and-forth movement of the lower end of the backrest associated with the reclining operation occur in a coordinated fashion.

4. The chair-type massage apparatus according to claim 3, wherein the seat is imparted with a forepart-ascent action that raises a forward end of the seat in response to a forward movement of the seat, and with a forepart-descent action that lowers the forward end of the seat in response to a backward movement of the seat.

5. The chair-type massage apparatus according to claim 1, wherein the rear end of the seat and the lower end of the backrest are coupled to each other for free rocking motion in the direction perpendicular to the horizontal direction of the apparatus,
thereby accomplishing concurrence between a back-and-forth movement of the seat, and a back-and-forth movement of the lower end of the backrest during the reclining operation, and
wherein the base frame includes:
a guide section for guiding the seat in free movement in a front-rear direction, and
an advance-retraction driving section for moving the seat in the front-rear direction.

6. The chair-type massage apparatus according to claim 5, wherein the guide section of the base frame is inclined forwardly and upwardly.

7. The chair-type massage apparatus according to claim 5, wherein said
wherein the backrest is capable of forward tilt, and
further comprising:
engaging means for engaging the lower end of the backrest and the rear end of the seat, the engaging means being adapted to retain the backrest in a stand-up state.

8. The chair-type massage apparatus according to claim 1, wherein the seat includes:
a leg kneading device mounted on a front side of the seat for massaging lower legs of the user,
wherein the massage portion for giving the massage to the user sitting on the seat is mounted separately from where the leg kneading device is mounted.

9. A chair-type massage apparatus comprising:
a seat;
a base frame for supporting the seat on a floor; and
a leg kneading device mounted on a front side of the seat,
wherein the frame includes a seat moving mechanism for moving the seat at least in a front-rear direction,
wherein the seat moving mechanism includes:
a guide section disposed in the base frame for guiding the seat in free movement in the front-rear direction, and
an advance-retraction driving section for moving the seat in the front-rear direction, and
wherein the seat includes:
a position changing mechanism for allowing changes in position of the leg kneading device relative to the seat while maintaining a relative distance between the seat and the leg kneading device, the position changing mechanism including:

a rocking arm for providing coupling between a base pivot disposed in the seat for supporting the seat for rocking motion in a direction perpendicular to a horizontal direction of the apparatus, and a front pivot disposed in the leg kneading device for supporting the leg kneading device for rocking motion in the direction perpendicular to the horizontal direction of the apparatus.

10. The chair-type massage apparatus according to claim 9, wherein the seat moving mechanism allows a forepart-ascent action that raises a forward end of the seat during forward movement of the seat and a forepart-descent action that lowers the forward end during backward movement of the seat, and wherein the position changing mechanism allows changes in position of the leg kneading device relative to the seat while maintaining a relative distance between the seat and the leg kneading device during the forepart-ascent action of the seat.

11. The chair-type massage apparatus according to claim 9, wherein the position changing mechanism has a lower arm member including a forwardly extending part, the forwardly extending part including:

a first portion extending downward from the base pivot of the seat, a second portion defining a forwardly pointing front end, a lower end of the first portion and a rear end of the second portion being joined at an bend of the forwardly extending part, and a telescoping rod disposed on the second portion defining the forwardly pointing front end for free forward sliding movement relative to the forwardly extending part, wherein a front end of the telescoping rod and the leg kneading device are coupled to each other for free rocking motion in the direction perpendicular to the horizontal direction of the apparatus.

12. The chair-type massage apparatus according to claim 9, wherein the rocking arm of the position changing mechanism includes:

a forwardly extending part including:

a first portion extending downward from the base pivot of the seat, a second portion defining a forwardly pointing front end, a lower end of the first portion and a rear end of the second portion being joined at a bend of the forwardly extending part, and a telescoping portion disposed on the second portion defining the forwardly pointing front end for free forward sliding movement relative to the forwardly extending part, wherein the telescoping portion of the rocking arm and the leg kneading device are coupled to each other for free rocking motion in the direction perpendicular to the horizontal direction of the apparatus.

13. The chair-type massage apparatus according to claim 9, wherein the position changing mechanism has an intermediate link coupled to a reverse pivot disposed on each of a right side and a left side of the leg kneading device for supporting the leg kneading device for rocking motion in the direction perpendicular to the horizontal direction of the apparatus, thereby allowing a reverse rotation for switching between a state where the leg kneading device stays with a massage surface thereof facing upward, and a state where the leg kneading device stays with the massage surface thereof facing the floor, wherein a front end of the rocking arm and one end of the intermediate link are coupled to each other for free rocking motion in the direction perpendicular to the horizontal direction of the apparatus.

14. The chair-type massage apparatus according to claim 9, wherein the position changing mechanism is designed to allow the leg kneading device to be housed in a housing area formed under the seat.

15. The chair-type massage apparatus according to claim 9, wherein the seat has a backrest reclinably mounted at a rear part thereof, and, during forward and backward reclining operations of the backrest, an upper end of the backrest moves up and down along one vertical line, and wherein the backrest has an upper end which moves downward concurrently with a forward movement of a lower end of the backrest during the backward reclining operation, whereas the upper end of the backrest moves upward concurrently with a backward movement of the lower end during the forward reclining operation.

* * * * *